United States Patent [19]

Fujita et al.

[11] Patent Number: 4,978,602

[45] Date of Patent: Dec. 18, 1990

[54] SILVER HALIDE PHOTOGRAPHIC LIGHT-SENSITIVE MATERIAL IMPROVED ON PINHOLE PRODUCTION

[75] Inventors: Akio Fujita; Takeshi Habu, both of Tokyo, Japan

[73] Assignee: Konica Corporation, Tokyo, Japan

[21] Appl. No.: 417,745

[22] Filed: Oct. 5, 1989

[30] Foreign Application Priority Data

Oct. 14, 1988 [JP] Japan ..... 63-258848

[51] Int. Cl.[5] ..... G03C 1/06

[52] U.S. Cl. ..... 430/264; 430/517; 430/536; 430/606

[58] Field of Search ..... 430/264, 517, 606, 536, 430/264, 517, 606, 536

[56] References Cited

U.S. PATENT DOCUMENTS 4,330,618 5/1982 Minamizono et al. ..... 430/536

4,803,149 2/1989 Takahashi et al. ..... 430/264

*Primary Examiner*—Paul R. Michl

*Assistant Examiner*—Thomas R. Neville

*Attorney, Agent, or Firm*—Frishauf, Holtz, Goodman & Woodward

[57] ABSTRACT

A silver halide photographic light-sensitive material is disclosed, which is suitable for contact printing in photomechanical process and capable of being handled in daylight room. The light-sensitive material comprises a support having thereon a silver halide emulsion layer containing a silver halide emulsion and a hydrazine compound or a tetrazolium compound, a layer being provided on the surface of said emulsion layer farther from said support and containing a compound having a maximum spectral absorption at a wavelength of at least 50 nm longer than that of the maximum spectral sensitivity of said silver halide emulsion, and a layer being interposed between said support and said emulsion layer and containing a macromolecular compound having a heterocyclic group having a sulfo group or an alkylsulfo group. The light-sensitive material is excellent in reverse-text quality and inhibited in formation of pinholes.

18 Claims, No Drawings

SILVER HALIDE PHOTOGRAPHIC LIGHT-SENSITIVE MATERIAL IMPROVED ON PINHOLE PRODUCTION

FIELD OF THE INVENTION

The present invention relates to a silver halide photographic light-sensitive material and especially to a silver halide photographic light-sensitive material which can be used under the circumstances so-called 'day-light room' when it is used in a graphic arts field.

BACKGROUND OF THE INVENTION

Recently, in the field of graphic arts, for labor-saving. rationalization and improvement of working conditions, a technology has been required for switching from the conventional dark room film making, the so-called contacting process, over to a day-light film making, and many improvements have been done about equipment of photographic light-sensitive materials and printers.

The photographic light-sensitive materials, which may be handled in day-light room, include those photosensitive to a light source emitting ample UV rays, such as a ultra high pressure mercury lamp, a metal halide light source, a xenon lamp, and a halogen lamp. These silver halide photographic light-sensitive materials can be handled under a normal fluorescent lamp as bright as 100 to 300 lux or a fluorescent lamp for exclusive use from which emits a small quantity of UV rays.

While these photographic light-sensitive materials, which contain a hydrazine or tetrazolium compound for producing ultra-high contrast images have such merits, they have the disadvantage that they are liable to produce the so-called pin-hole trouble in blackened images after they are developed.

The term, pin-hole, herein means a phenomenon that a white spot having a size of about 30 μm or smaller is produced in a blackened image. As the spot has a circular or amorphous shape and it looks as if it were made by piercing with a pin, so it has been named so.

Fidelity of halftone image reproduction cannot be obtained in a contact printing process, if the film for contact process itself has abnormal blackened dots caused by 'pin-hole'. Therefore, the produced pin-holes must be prevented by making them opaque, so that the operation efficiency has been remarkably worsened. There has been one of the countermeasures in which any compound having an absorption in a wavelength region longer than that of silver halide shall not be contained in the film. In this measure, however, the film cannot be handled in bright working conditions and the merits of day light operation is diminished.

For such present condition, there have been strong demands for a day light film in which pin-hole are hardly produced.

SUMMARY OF THE INVENTION

It is an object of the invention to provide a silver halide photographic light-sensitive material in which no pin-hole can be produced when exposing the light-sensitive material to a selected light-source.

Another object of the invention is to provide a silver halide photographic light-sensitive material in which contacting characteristics for graphic arts use, such as quality of a reversed character image superposed on a halftone background hereinafter called reverse text quality, are improved.

It was discovered that the above-mentioned purposes of invention can be accomplished with a silver-halide photographic light-sensitive material comprising a support having thereon an emulsion layer containing a hydrazine or tetrazolium compound, a layer provided on the emulsion layer and containing a compound having a spectral absorption maximum in a wavelength at least 50 nm longer than the wavelength of maximum spectral sensitivity of the silver halide grains containing in the emulsion layer and a layer interposed between the emulsion layer and the support and containing a macromolecular compound having a heterocyclic ring which has at least one sulfonic acid group or substituted alkyl sulfonic acid group.

DETAILED DESCRIPTION OF THE INVENTION

The hydrazine compounds applicable to the present invention include, preferably, the compounds represented by the following Formula I-a.

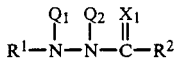

Formula I-a

In the formula, $R^1$ is a univalent organic group: $R^2$ is a hydrogen atom or a univalent organic group: $Q_1$ and $Q^2$ are each a hydrogen atom, an alkylsulfonyl group including that having a substituent, or an arylsulfonyl group including that having a substituent; and $X_1$ is an oxygen or sulfur atom. Among the compounds represented by Formula I, what is more preferable is the compounds in which $X_1$ is an oxygen atom and $R_2$ is a hydrogen atom.

The above-mentioned univalent organic groups represented by $R^1$ and $R^2$ include, for example, aromatic, heteroaromatic, and aliphatic groups.

Such aromatic groups include, for example, a phenyl group, and a naphthyl group and these groups having a substituent such as an alkyl, alkoxy, acylhydrazino, dialkylamino, alkoxycarbonyl, cyano, carboxy, nitro, alkylthio, hydroxy, sulphonyl, or carbamoyl group, a halogen atom, an acylamino, sulfonamido, or thiourea group. As the actual examples of such aromatic groups each having a substituent include 4-methylphenyl group, 4-ethylphenyl group. 4-oxyethylphenyl group, 4-dodecylphenyl group, 4-carboxyphenyl group, 4-diethylaminophenyl group, 4-octylaminophenyl group, 4-benzylaminophenyl group, 4-acetamido2-methylphenyl group, 4-(3-ethylthioureido)phenyl group, and 4-[2-(2,4-di-tert-butylphenoxy)butylamido]phenyl group.

The heterocyclic groups include, for example, 5- or 6-membered single or condensed rings containing at least one of oxygen, nitrogen, sulfur or selenium atoms. Each of these rings may also have a substituent. Typically, such heterocyclic groups include those having a ring of pyrroline, pyridine, quinoline, indole, oxazole, benzoxazole, naphthoxazole, imidazole, benzoimidazole, thiazoline, thiazole, benzothiazole, naphthothiazole, selenazole, benzoselenazole, and naphthoselenazole.

These heterocyclic rings may be substituted with an alkyl group having 1 to 4 carbon atoms such as a methyl or ethyl group, an alkoxy group having 1 to 4 carbon atoms such as a methoxy or ethoxy group, an aryl group having 6 to 18 carbon atoms such as a phenyl group, a halogen atom such as chlorine or bromine atom, an alkoxycarbonyl group, a cyano group, or an amino group.

The aliphatic groups include, for example, a straight- or branch-chained alkyl or cycloalkyl group, each of those having a substituent, an alkenyl group, and an alkinyl group.

The straight- and branch-chained alkyl groups include, for example, those having 1 to 18 carbon atoms and, preferably, those having 1 to 8 carbon atoms. They include, typically, a methyl group, an ethyl group, an isobutyl group, and a 1-octyl group.

The cycloalkyl groups include, for example, those having 3 to 10 carbon atoms and, typically, a cyclopropyl group, a cyclohexyl group, and an adamantyl group. The substituents to such alkyl and cycloalkyl groups include, for example, alkoxy groups such as a methoxy group, an ethoxy group, a propoxy group, and a butoxy group, an alkoxycarbonyl group, a carbamoyl group, a hydroxy group, an alkylthio group, an amido group, an acyloxy group, a cyano group, a sulfonyl group, halogen atoms such as a chlorine atom, a bromine atom, a fluorine atom and an iodine atom, and aryl groups such as a phenyl group, a halogen-substituted phenyl group, and an alkyl-substituted phenyl group. The typical examples of the substituents having a substituent include a 3-methoxypropyl group, an ethoxycarbonylmethyl group, 4-chlorocyclohexyl group, a benzyl group, a p-metylbenzyl group, and a p-chlorobenzyl group.

Further, the alkenyl groups include an allyl group, and the alkinyl groups include a propargyl group.

The preferable examples of the hydrazine compounds will be given hereunder. It is, however, to be understood that the present invention shall not be limited thereto.

(I- 1) 1-formyl-2-{4-[2-(2,4-di-tert-butylphenoxy)-butylamido]phenyl}hydrazine
(I- 2) 1-formyl-2-(4-diethylaminophenyl)hydrazine
(I- 3) 1-formyl-2-(p-toryl)hydrazine
(I- 4) 1-formyl-2-(4-ethylphenyl)hydrazine
(I- 5) 1-formyl-2-(4-acetamido-2-methylphenyl)hydrazine
(I- 6) 1-formyl-2-(4-oxyethylphenyl)hydrazine
(I- 7) 1-formyl-2-(4-N,N-dihydroxydiethylamino-phenyl)-hydrazine
(I- 8) 1-formyl-2-( 4-(3-ethylthioureido)phenyl]hydrazine
(I- 9) 1-thioformyl-2-{4-[2-(2,4-di-tert-butylphenoxy)-butylamido]phenyl}hydrazine
10) 1-formyl-2-(4-benzylaminophenyl)hydrazine
(I-11) 1-formyl-1-(4-octylaminophenyl)hydrazine
(I-12) 1-formyl-2-(4-dodecylphenyl)hydrazine
(I-13) 1-acetyl-2-{4-2-2,4-di-tert-butylphenoxy)-butylamido]phenyl}hydrazine
(I-14) 4-carboxyphenylhydrazine
(I-15) 1-acetyl-1-(4-methylphenylsulfonyl)-2-phenylhydrazine
(I-16) 1-ethoxycarbonyl-1-(4-methylphenylsulfonyl)-2-phenylhydrazine
(I-17) 1-formyl-2-(4-hydroxyphenyl)-2-(4-methylphenylsulfonyl)-hydrazine
(I-18) 1-(4-acetoxyphenyl)-2-formyl-1-(4-methylphenylsulfonyl)-hydrazine
(I-19) 1-formyl-2-(4-hexanoxyphenyl)-2-(4-methylphenylsulfonyl)-hydrazine
(I-20)1-formyl-2-[4-(tetrahydro-2H-pyrane-2-yloxy)-phenyl]-2-(4-methylphenylsulfonyl)-hydrazine
(I-21) 1-formyl-2-[4-(3-hexylureidophenyl)]-2-(4-methylphenylsulfonyl)-hydrazine
(I-22) 1-formyl-2-(4-methylphenylsulfonyl)-2-[4-(phenoxythiocarbonylamino)-phenyl]-hydrazine
(I-23) 1-(4-ethoxythiocarbonylaminophenyl)-2-formyl-1-(4-metylphenylsulfonyl)-hydrazine
(I-24) 1-formyl-2-(4-methylphenylsulfonyl)-2-[4-(3-methyl-3-phenyl-2-thioureido)-phenyl]-hydrazine
(I-25) 1-{{4-{3-[4-(2,4-bis-t-amylphenoxy)-butyl]-ureido}-phenyl}}-2-formyl-1-(4-methylphenylsulfonyl)-hydrazine (I-26)

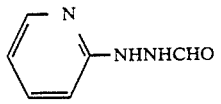

(I-27)

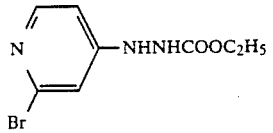

(I-28)

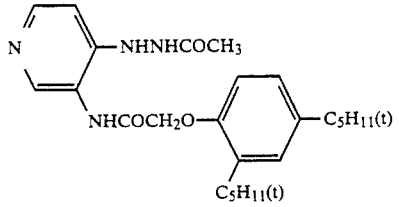

(I-29)

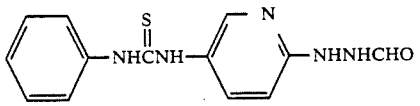

-continued
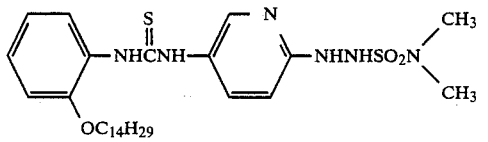
(I-30)
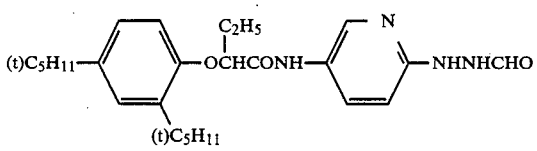
(I-31)
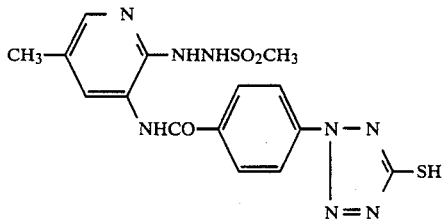
(I-32)
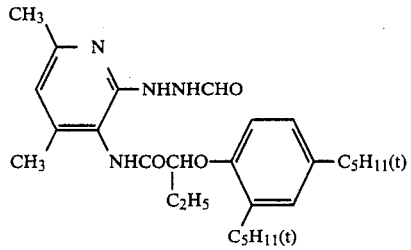
(I-33)
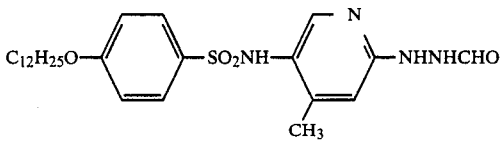
(I-34)
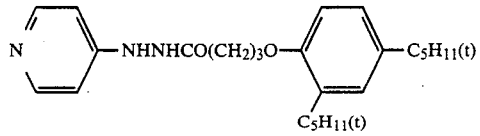
(I-35)
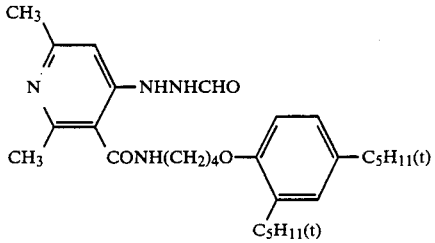
(I-36)
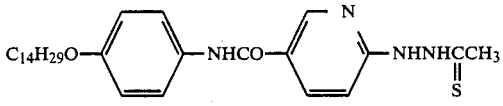
(I-37)
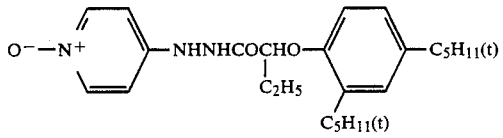
(I-38)

-continued
(I-39)
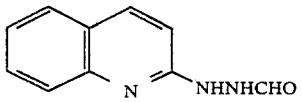
(I-40)
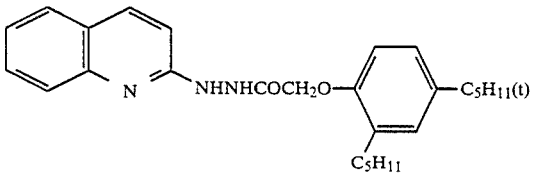
(I-41)
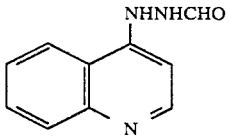
(I-42)
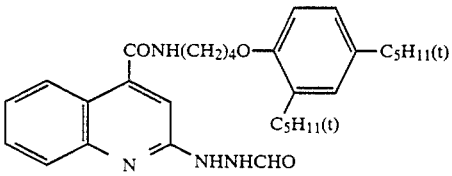
(I-43)
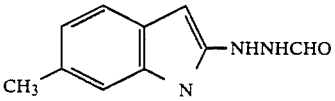
(I-44)
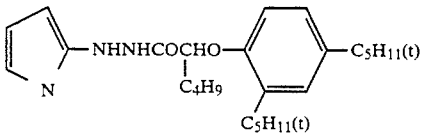
(I-45)
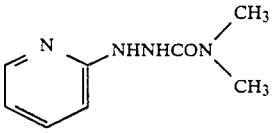
(I-46)
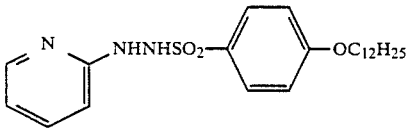
(I-47)
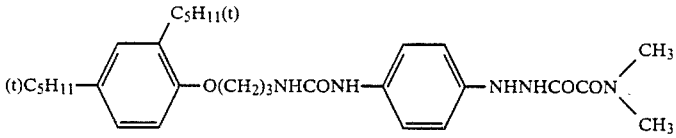
(I-48)
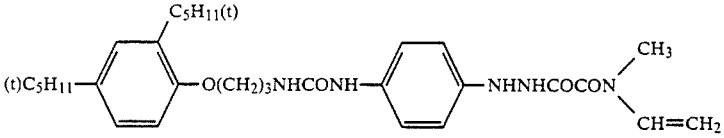

-continued
(I-49)
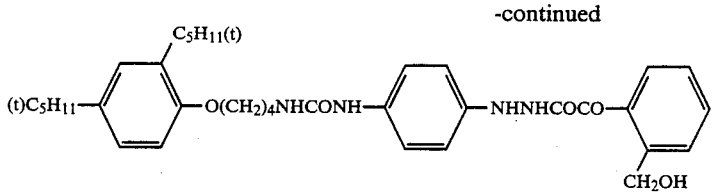
(I-50)
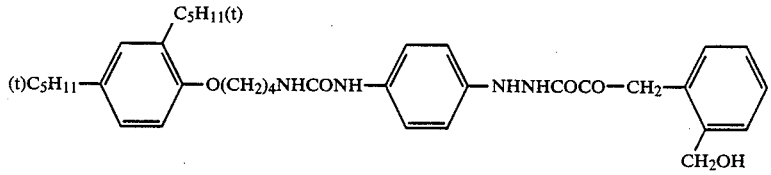
(I-51)
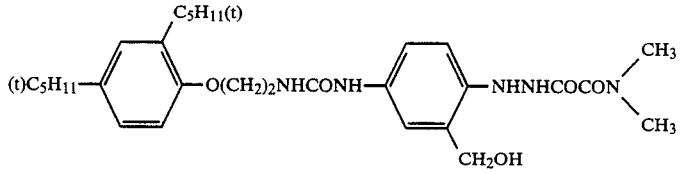
(I-52)
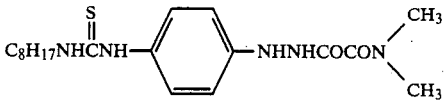
(I-53)
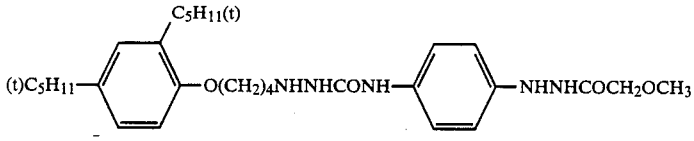
(I-54)
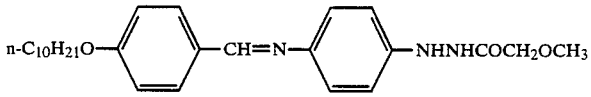
(I-55)
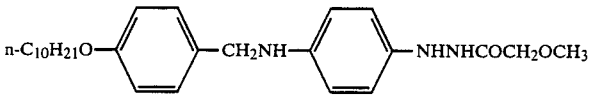
(I-56)
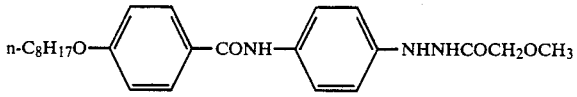
(I-57)
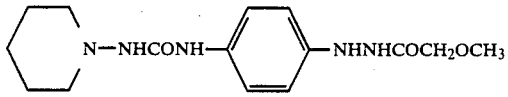
(I-58)
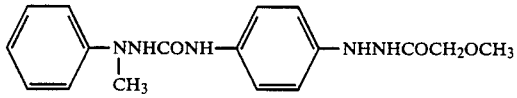
(I-59)
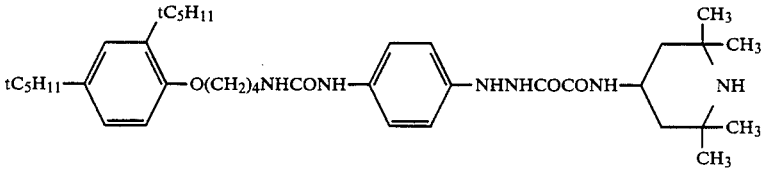
The hydrazine compound represented by Formula I-a is to be added to a silver halide emulsion layer and/or a non-sensitive layer arranged onto the silver halide emulsion layer side of the support and, preferably, to the silver halide emulsion layer and/or the layer adjacent to lower side of the emulsion layer. They are to be added in an amount within the range of, preferably, $10^{-5}$ to $10^{-1}$ mol per mol of silver. silver and, more preferably, $10^{-4}$ to $10^{-2}$ mol per mol of Now, the tetrazolium compounds applicable to the present invention will be detailed.

Such tetrazolium compounds can be represented by the following Formula I-b, I-c, or I-d.

Formula I-b

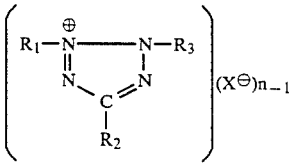

Formula I-c

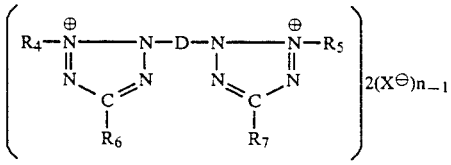

Formula I-d

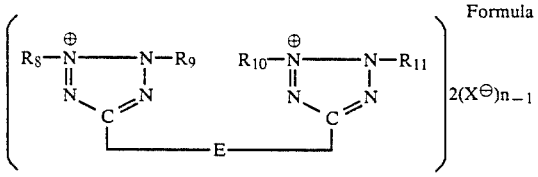

Wherein $R_1$, $R_3$, $R_4$, $R_5$, $R_8$, $R_9$, and $R_{11}$ are each an alkyl group such as a methyl group, an ethyl group, a propyl group or a dodecyl group; an alkenyl group such as vinyl group, an allyl group, and or propenyl group; an aryl group such as a phenyl group, a tolyl group, a hydroxyphenyl group, a carboxyphenyl group, an aminophenyl group, a mercaptophenyl group, an $\alpha$-naphthyl group, a $\beta$-naphthyl group, a hydroxynaphthyl group, a carboxynaphthyl group, and an aminonaphthyl group; or a heterocyclic group such as a thiazolyl group, a benzothiazolyl group, an oxazolyl group, a pyrimidinyl group or a pyridyl group. They may also be such groups as are capable of forming a metal chelate or complex.

$R_2$, $R_6$ and $R_7$ are each an allyl group; a phenyl group which may have a substituent; a naphthyl group which may have a substituent; a heterocyclic group; an alkyl groups such as a methyl group, an ethyl group, a propyl group, a butyl group, a mercaptomethyl group, and a mercaptoethyl group; a hydroxyl group; a carboxyl group and the salts thereof, an alkoxycarbonyl groups such as a methoxycarbonyl group and an ethoxycarbonyl group; an amino group such as an amino group, an ethylamino group, and an anilino group; a mercapto group: a nitro group or a hydrogen atom. D is a 2-valent aromatic group. E is an alkylene groups, an allylene group or an aralkylene groups. $X^{\ominus}$ is an anion. n is an integral number of one or two, provided, when the compound forms an intramolecular salt, n is one. Now, the actual examples of tetrazolium compounds represented by the foregoing Formula I-b, I-c or I-d will be given below. However, the present invention shall not be limited to them only.

(1) 2-(benzothiazole-2-yl)-3-phenyl-5-dodecyl-2H-tetrazolium
(2) 2,3-diphenyl-5-(4-t-octyloxyphenyl)-2H-tetrazolium
(3) 2,3,5-triphenyl-2H-tetrazolium
(4) 2,3,5-tri(p-carboxyethylphenyl)-2H-tetrazolium
(5) 2-(benzothiazole-2-yl)-3-phenyl-5-(o-chloropheny)-2H-tetrazolium
(6) 2,3-diphenyl-2H-tetrazolium
(7) 2,3-diphenyl-5-methyl-2H-tetrazolium
(8) 3-(p-hydroxyphenyl)-5-methyl-2-phenyl-2H-tetrazolium
(9) 2,3-diphenyl-5-ethyl-2H-tetrazolium
(10) 2,3-diphenyl-5-n-hexyl-2H-tetrazolium
(11) 5-cyano-2,3-diphenyl-2H-tetrazolium
(12) 2-(benzothiazole-2-yl)-5-phenyl-3-(4-tolyl)-2H-tetrazolium
(13) 2-(benzothiazole-2-yl)-5-(4-chlorophenyl)-3-(4-nitrophenyl)-2H-tetrazolium
(14) 5-ethoxycarbonyl-2,3-di(3-nitrophenyl)-2H-tetrazolium
(15) 5-acetyl-2,3-di(p-ethoxyphenyl)-2H-tetrazolium
(16) 2,5-diphenyl-3-(p-tolyl)-2H-tetrazolium
(17) 2,5-diphenyl-3-(p-iodophenyl)-2H-tetrazolium
(18) 2,3-diphenyl-5-(p-diphenyl)-2H-tetrazolium
(19) 5-(p-bromophenyl)-2-phenyl-3-(2,4,6-trichlorophenyl)-2phenyl)-2H-tetrazolium
(20) 3-(p-hydroxyphenyl)-5-(p-nitrophenyl)-2-phenyl-2H-tetrazolium
(21) 5-(3,4-dimethoxyphenyl)-3-(2-ethoxyphenyl)-2-(4-methoxyphenyl)-2H-tetrazolium
(22) 5-(4-cyanophenyl)-2,3-diphenyl-2H-tetrazolium
(23) 3-(p-acetamidophenyl)-2,5-diphenyl-2H-tetrazolium
(24) 5-acetyl-2,3-diphenyl-2H-tetrazolium
(25) 5-(fran-2-yl)-2,3-diphenyl-2H-tetrazolium
(26) 5-(thiophene-2-yl)-2,3-diphenyl-2H-tetrazolium
(27) 2,3-diphenyl-5-(pyrido-4-yl)-2H-tetrazolium
(28) 2,3-diphenyl-5-(quinol-2-yl)-2H-tetrazolium
(29) 2,3-diphenyl-5-(benzoxyazol-2-yl)-2H-tetrazolium
(30) 2,3,5-tri(p-ethylphenyl)-2H-tetrazolium
(33) 2,3,5-tri(p-allylphenyl)-2H-tetrazolium
(32) 2,3,5-tri(p-hydroxyethyloxyethoxyphenyl)-2H-tetrazolium
(33) 2,3,5-tri(p-dodecylphenyl)-2H-tetrazolium
(34) 2,3,5-tri(p-benzylphenyl)-2H-tetrazolium These anion portions represented by $X^{\ominus}$ denoted in the above-given Formula I-b or I-c include halogen ions such as $Cl^{\ominus}$.

The tetrazolium compounds applicable to the invention may be used independently or in combination in any desired proportions.

In the embodiments of the invention, such tetrazolium compound relating to the invention is added into a silver halide emulsion layer.

The tetrazolium compounds relating to the invention may be used in an amount within the range of, preferably, $1\times10^{-6}$ to 10 mols per mol of silver halides contained in a light-sensitive material of the invention and, more preferably, $2\times10^{-4}$ to $2\times10^{-1}$ mol.

In a preferable embodiment of the invention, a layer containing a macromolecular compound which has a heterocyclic group having a sulfo group or an alkyl sulfo group as a substituent, an silver halide emulsion layer containing a hydrazine or a tetrazolium compound, and a layer containing a compound having a spectral absorpting maximum in a region 50 mm longer than the wavelength of the maximum spectral sensitivity, are provided on a support in the above order. On the upper or lower side or between these layers, a subbing layer an inter layer or a protective layer may also be arranged.

It is further preferable to provide a subbing layer onto the support and a layer containing the compound of the invention thereover and further to coat an emulsion layer on.

A molecular weight of the macromolecular compound applicable to the invention is preferably within the range of 200 to 2 million.

The heterocyclic rings of the macromolecular compounds of the invention include those of pyridine, pyrrolidine, carbazole, pyrrole, thiophene, fran, and indole, as the preferable examples thereof. And, the sulfo groups include, for example, an alkylsulfo group having 1 to 16 carbon atoms or a substituted alkyl sulfo group.

As the typical examples of the macromolecular compounds of the invention, homopolymers, copolymers, and terpolymers will be listed up below. The compounds shall not however be limited thereto.

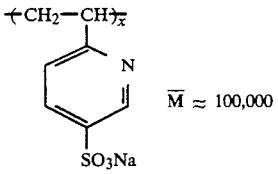

$\overline{M} \approx 100{,}000$ (1)

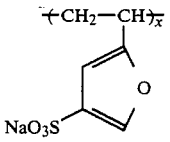

$\overline{M} \approx 200{,}000$ (2)

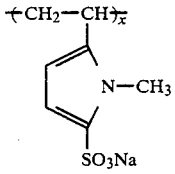

$\overline{M} \approx 200{,}000$ (3)

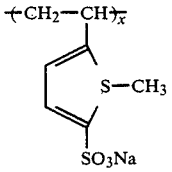

$\overline{M} \approx 150{,}000$ (4)

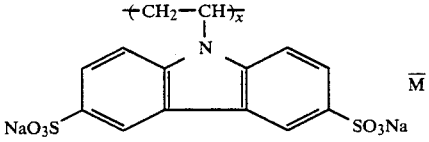

$\overline{M} \approx 300{,}000$ (5)

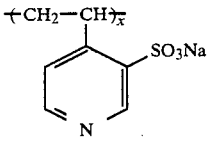

$\overline{M} \approx 280{,}000$ (6)

-continued

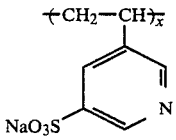

$\overline{M} \approx 450{,}000$ (7)

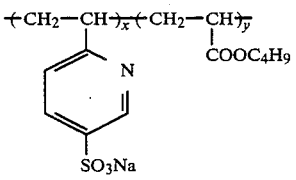

x:y = 60:40 $\overline{M} \approx 800{,}000$ (8)

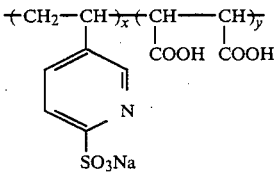

x:y = 70:30 $\overline{M} \approx 650{,}000$ (9)

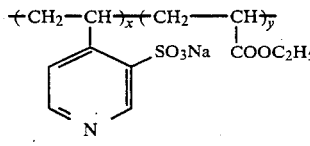

x:y = 80:20 $\overline{M} \approx 500{,}000$ (10)

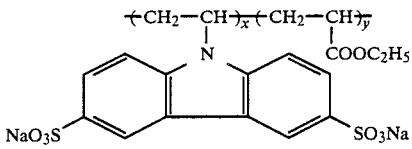

x:y = 75:25 $\overline{M} \approx 400{,}000$ (11)

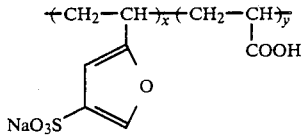

x:y = 80:20 $\overline{M} \approx 600{,}000$ (12)

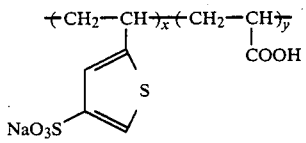

x:y = 90:10 $\overline{M} \approx 400{,}000$ (13)

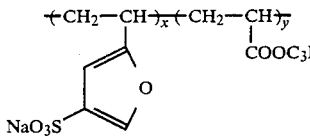

x:y = 55:45 $\overline{M} \approx 320{,}000$ (14)

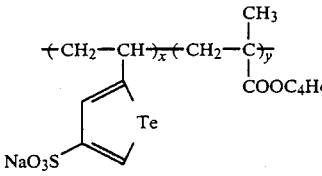

x:y = 90:10 $\overline{M} \approx 600{,}000$ (15)

-continued (16)

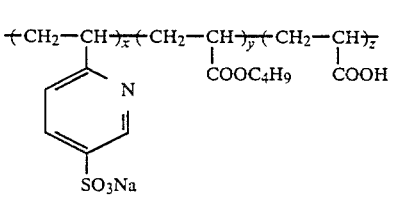

x:y:z = 80:10:10

$\overline{M} \approx 800,000$ (17)

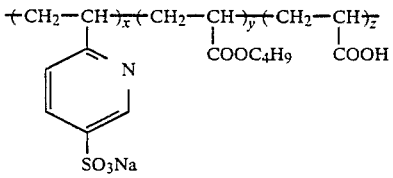

x:y:z = 70:25:5

$\overline{M} \approx 300,000$ (18)

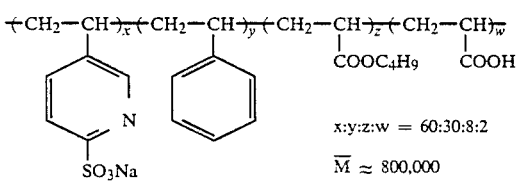

x:y:z:w = 60:30:8:2

$\overline{M} \approx 800,000$ (19)

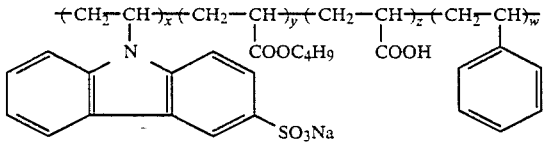

x:y:z:w = 50:30:10:10

$\overline{M} \approx 600,000$ (20)

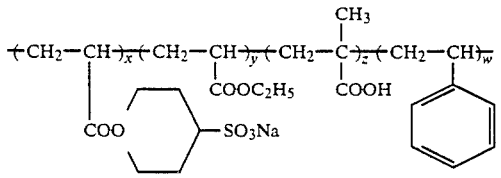

x:y:z:w = 40:30:20:10

$\overline{M} \approx 500,000$ (21)

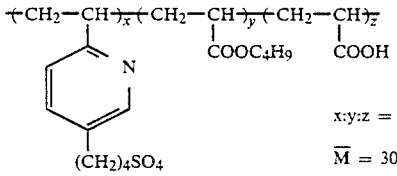

x:y:z = 60:30:10

$\overline{M} = 300,000$ (22)

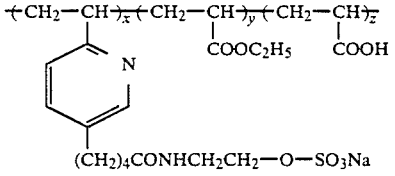

x:y:z = 40:30:30

$\overline{M} = 500,000$

-continued (23)

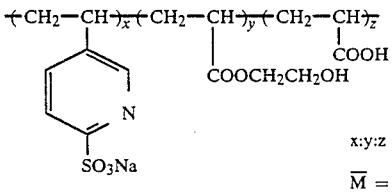

x:y:z = 55:35:10

$\overline{M} = 300,000$ (24)

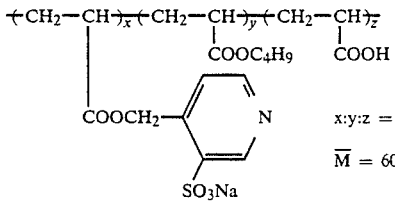

x:y:z = 50:30:20

$\overline{M} = 600,000$ (25)

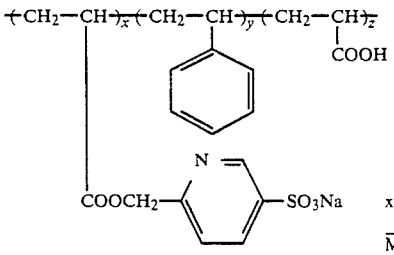

x:y:z = 60:30:10

$\overline{M} = 600,000$

Monomers capable of producing the above-mentioned macromolecular compounds of the invention can be polymerized with a polymerization initiator in a media such as water an alcohol such as methanol or ethanol, a hydrophilic colloidal solution matrix such as an aqueous gelatin solution, and a high boiling solvent such as sodium tricrezylphosphate, or liquid paraffin. After polymerization, the media containing the produced polymer can be added to the coating solution of the layer.

These compounds may be added in the layer in an amount within the range of, preferably, $10^{-3}$ to $10^{3}$ mg/m$^2$ and, more preferably, $10^{-1}$ to $10^{2}$ mg/m$^2$.

The macromolecular compounds of the invention may be readily synthesized by making use of the polymer-producible monomers which are available on the market.

The silver halide photographic light-sensitive materials of the invention are to be contained a compound having an spectral absorption maximum in a wavelength region at least 50 nm longer than the wavelength of maximum spectral sensitivity of the silver halide grains used so that the light-sensitive materials may be handled in day-light room.

The absorption maximum wavelength of the above-mentioned compound depends on various composition of the layer in which the compound to be added. Such absorption maximum wavelength may be determined by measuring absorption spectra of the layer. According to the invention, it is required to contain them in a layer such as a protective layer which is arranged farther from the support. It is also allowed to contain them in an interlayer between the silver halide emulsion layer and the protective layer. The effects of the invention may be more improved when applying the layer containing the above-mentioned compounds with a substance such as a basic mordant or an acid-treated gelatin having a high isoelectric point each capable of fixing the above mentioned compounds.

The above-mentioned compounds having an absorption maximum at least 50 nm longer than the wavelength of the maximum spectral sensitivity wavelength of the silver halide grains used are preferably used in an amount within the range of about 5 mg to 3 g per sq.meter. And, the optical density of the layer containing the compound in the absorption maximum wavelength of the compound is desirably not less than 0.10. Further, in an absorption maximum wavelength, the maximum absorption is in at least 50 nm longer wavelength side. In order to display satisfactory effects, it is preferable to be a longer wavelength of not longer than 300 nm and more preferable to be not longer than 200 nm. Besides, when containing two or more kinds of such compounds in combination, for example, when containing one having a 50 to 100 nm longer wavelength and the other having a 100 to 200 nm longer wavelength, more preferable effect can be enjoyed.

These compounds are represented by the following Formulas II-a, II-b and II-c and are typically exemplified by the following compounds. The compounds shall not be limited thereto.

Formula II-a

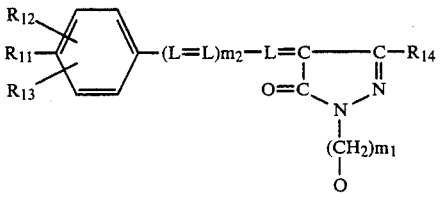

In the formula, $R_{11}$ is the group consisting of atoms represented by —OX or

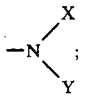

X and Y are each a hydrogen atom, an alkyl group, or a substituted alkyl group such as a cyanoalkyl group, a carboxyalkyl group, a sulfoalkyl group or the potassium or sodium salt thereof, a hydroxyalkyl, a halogenoalkyl group or the potassium or sodium salt thereof, a $R_{12}$ and $R_{13}$ are each a hydrogen atom, a halogen atom, an alkyl group, a hydroxy group, an alkoxy group, an alkylthio group, or the same group as the foregoing —OX group; Q is a phenyl group having at least one halogen atom, a carboxy group, a sulfo group, a sulfoalkyl group and a sodium or potassium salt of the sulfo or sulfoalkyl group, or a sulfoalkyl group, a sulfoalkoxyalkyl group or a sulfoalkylthioalkyl group; L is a methine group which may be substituted; $R_{14}$ is an alkyl group, a carboxy group, an alkyloxycarbonyl group, or an acyl-substituted, sulfosubstituted, or non-substituted amino group; $m_1$ is an integer of 0, 1 or 2; and $m_2$ is an integer of 0 or 1.

Formula II-b

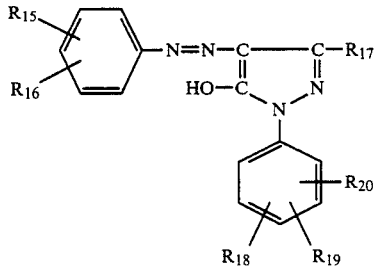

In the formula. $R_{15}$, $R_{16}$, $R_{18}$, $R_{19}$ and $R_{20}$ are each a hydrogen atom, a halogen atom, an alkyl group, a hydroxyl group, an alkoxy group, an amino group, an acylamino group, a carboxyl group, or a sulfo group or the potassium or sodium salt thereof; $R_{17}$ is an alkyl group or a carboxyl group.

Formula II-c

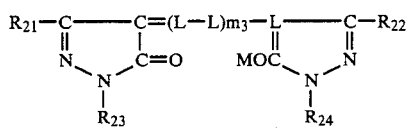

In the formula, $R_{21}$ and $R_{22}$ are each an alkyl group, a substituted alkyl group, an aryl group, an alkoxycarbonyl group or a carboxyl group; $R_{23}$ and $R_{24}$ are each an alkyl group having a sulfo group or a carboxyl group as substituent, or an aryl group having a sulfonic acid group or a carboxy group as substituent, provided, the sulfo group and carboxyl group include each the sodium or potassium salts thereof; L is a substituted or unsubstituted methine group; M is a sodium, potassium or hydrogen atom; and $m_3$ is an integer of 0 or 1.

Now, the typical examples of the compounds represented by Formulas II-a, II-b, and II-c will be given below.

(II-1)

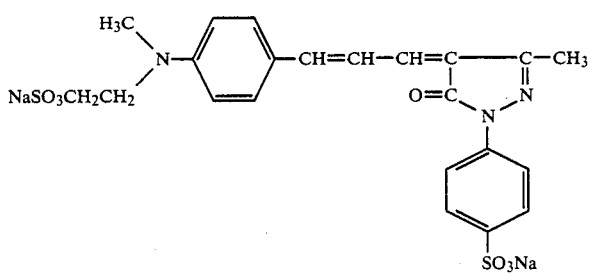

-continued
(II-2)
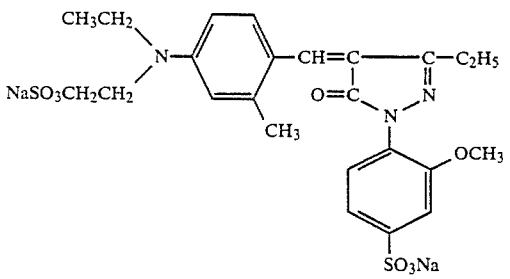
(II-3)
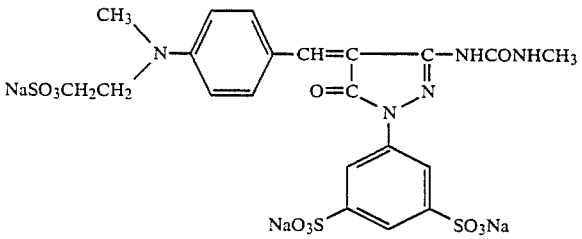
(II-4)
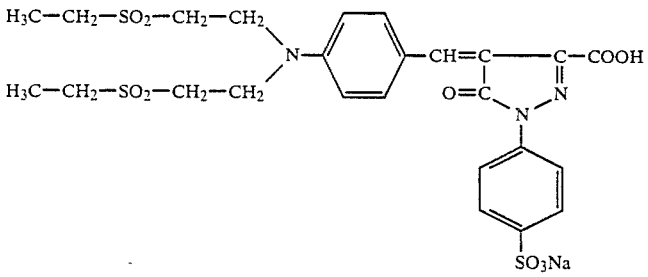
(II-5)
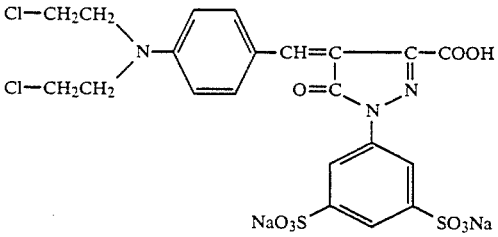
(II-6)
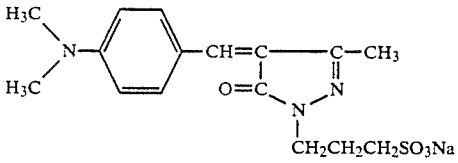
(II-7)
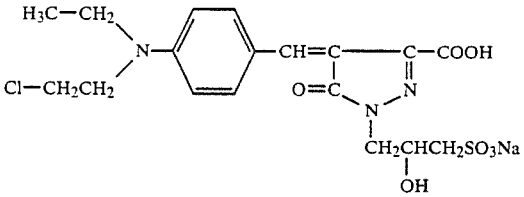
(II-8)
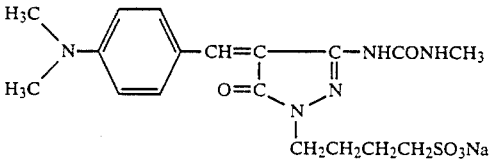

-continued
(II-9)
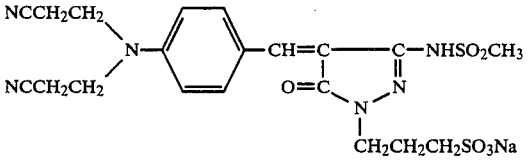
(II-10)
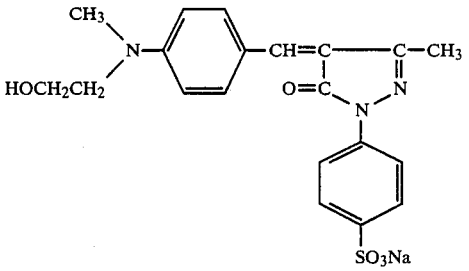
(II-11)
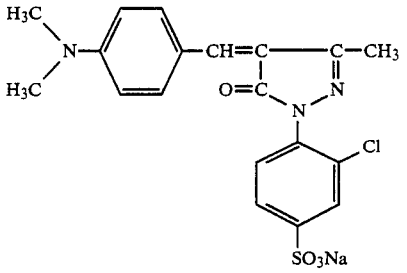
(II-12)
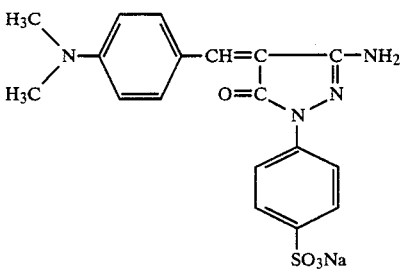
(II-13)
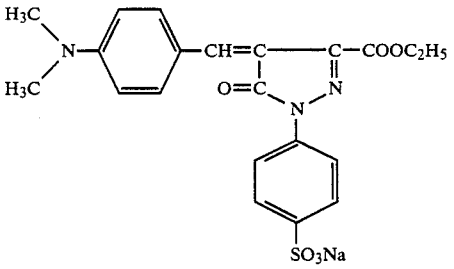
(II-14)
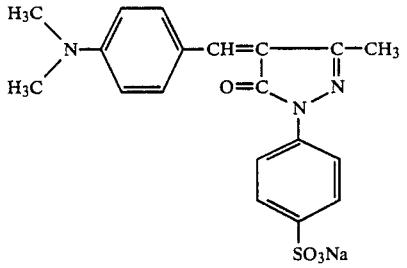

-continued
(II-15)
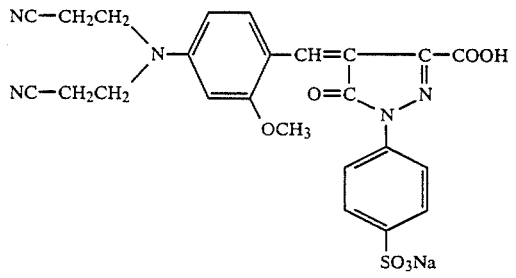
(II-16)
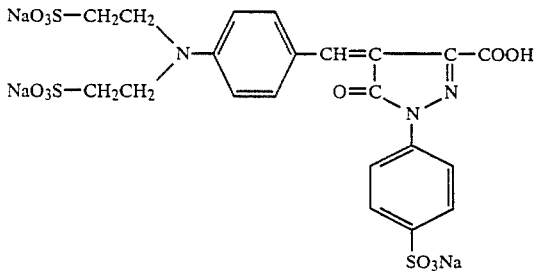
(II-17)
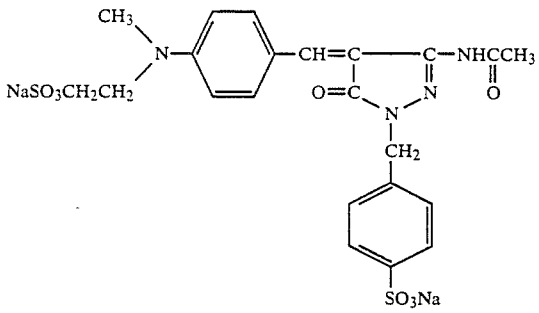
(II-18)
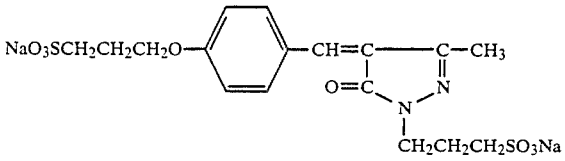
(II-19)
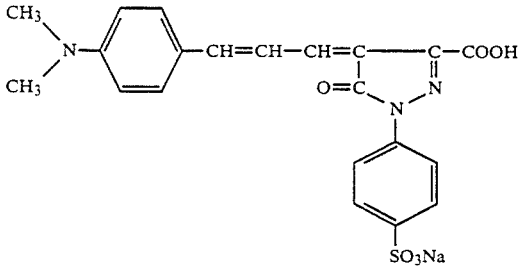
(II-20)
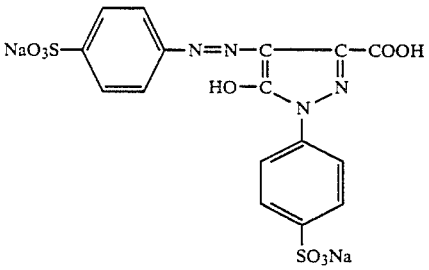

-continued
(II-21)
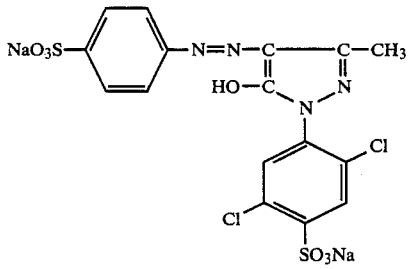
(II-22)
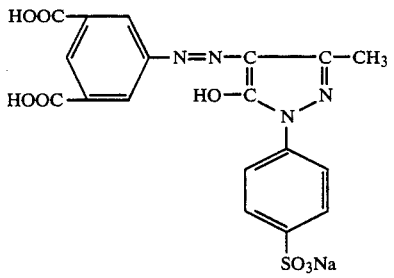
(II-23)
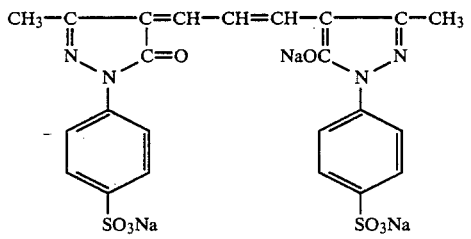
(II-24)
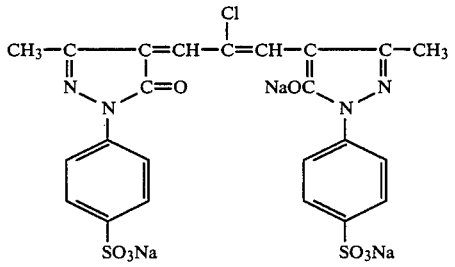
(II-25)
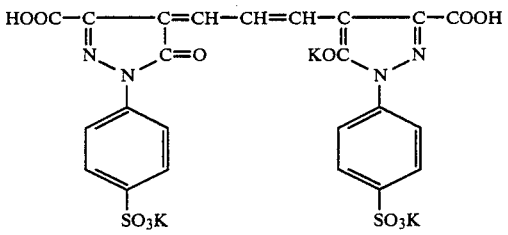
(II-26)
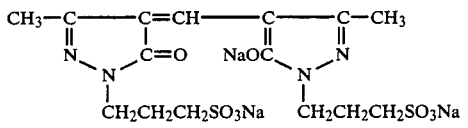

-continued

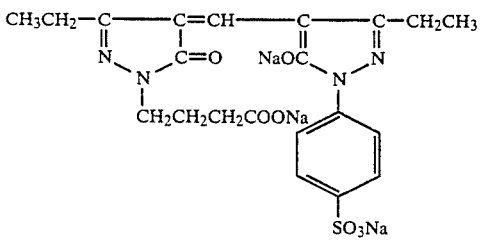

(II-27)

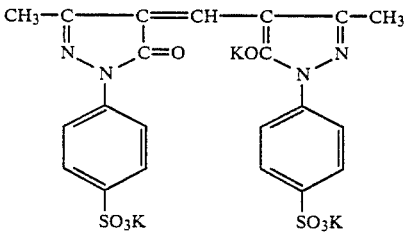

(II-28)

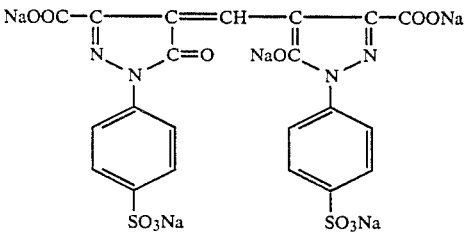

(II-29)

A light source substantially having an energy within the range of 300 to 430 nm and, preferably, 350 to 400 nm is used to serve as the light source for exposing thereto a light-sensitive material of the invention.

It is preferable to use any light emitting type light sources, provided they are within the above-mentioned range and there is no limitation to whether filaments or electrodes are equipped or not. As for the luminous gasses which may be contained in a light-emitting electrode tube, it is allowed to use halogen gasses, rare gasses, or the mixtures thereof and it is also allowed to contain a metal for emitting light together with the above-mentioned gasses in to the tube.

As for the light sources satisfying the above-mentioned purpose, it is generally preferable to use a ultra-high pressure mercury lamp or a metal halide lamp and, besides, spectra emitted from a V-bulb-type non-electrode discharge bulb of which will be detailed later. Such discharge bulbs of this type are available from Fusion Company, U.S.A. of other light source manufacturers, and these light sources are disclosed in, for example, U.S. Pat. Nos. 4,254,363, 4,010,400, 993,379, 3,950,670, 3,873,884, 3,790,852, 3,787,7005, 3,786,308, 3,645,629, 4,536,675, 4,422,017, 4,415,838, 4,390,813, 4,383,203, 4,359,668, 3,911,318, 3,872,349, 3,983,039, 4,042,850, 4,208,587, 4,313,969, and 4,269,581.

The light sources each having an energy substantially within the range of 300 to 430 nm include those attached to a ultra-high pressure mercury lamp or a metal halide lamp with a spectral absorbing filter capable of cutting short wavelengths of not longer than 300 nm but allowable of either cutting or not cutting long wavelength of not shorter than 430 nm so as to obtain the spectra similar to that emitted from the above-mentioned V-bulb type light sources. Besides the above, use high luminance type halogen lamps may be use for this purpose.

The silver halides applicable to the silver halide photographic light-sensitive materials relating to the invention include, preferably, silver chloride, silver chlorobromide, silver chloroiodobromide, and so forth, each having any compositions and a silver chloride content of at least 50 mol %. Such silver halides are preferably used when they have an average grain size within the range of 0.025 to 0.5 μm and, more preferably, when the average grain size is within the range of 0.05 to 0.30 μm.

The monodispersion degrees of the silver halide grains relating to the invention can be defined by the following Formula 1. The values of such dispersion degrees may be adjusted to be within the range of, preferably, 5 to 60 and, more preferably, 8 to 30. The grain sizes of the silver halide grains relating to the invention may be expressed in terms of the edge-length of a cubic crystal grain for convenience, and the monodispersion degrees are expressed by a value of 100-fold multiplying the quotient obtained by dividing a standard deviation of grain sizes by an average grain size.

$$\sqrt{\frac{\Sigma(r - ri)^2 ni}{\Sigma ni}} - r \times 100 \qquad (1)$$

In the equation, $\bar{r}$ is the average grain size, ri is the size of individual grain and ni is number of the individual grains. The silver halide grains applicable to the invention include, preferably, a multilayer-structured grains having at least two-layer-structure. It is also allowed to use, for example, the silver chlorobromide grains of which the cores contain silver chloride and the shells contain silver bromide and, contrarily, those of which the cores contain silver bromide and the shells contain silver chloride. In these cases, an iodide may be contained in an amount of not more than 5 mol % into any layers.

It is further allowed to use at least two kinds of grains mixed together. For example, the main grains may be cubic, octahedral or tabular shaped silver chloroiodobromide grains having a silver chloride content of not more than 10 mol % and an iodide content of not more than 5 mol % and secondary grains may be cubic, octahedral, or tabular shaped silver chloroiodobromide grains having a silver chloride content of not less than 50 mol % and an iodide content of not more than 5 mol %, so as to use as a mixture thereof. In the case of mixedly using grains, the photosensitivity may be lowered either by moderating secondary grains in chemical sensitization compared to the case of the main grains, or by adjusting an amount of such a noble metal as rhodium which is to be doped in the surface or inside of each grain. It is further allowed to fog the inside of each secondary grain by making use of gold or by changing the compositions of the cores and shells of grains in a core/shell method. About the sizes of main and secondary grains, the smaller, the better. For example, any sizes within the range of 0.025 to 1.0 μm may be taken.

In the course of preparing a silver halide emulsion applicable to the invention, it is allowed to control sensitivity or contrast by adding a rhodium salt. It is generally preferable to add a rhodium salt in the step of growing grains and it is also allowed to add it either in a chemical ripening step or in the course of preparing an emulsion coating solution.

The rhodium salts which may be added to the silver halide emulsions applicable to the invention may be the complex salts thereof as well as the simple salts thereof. Such rhodium salts include, typically, hexachloroiodate rhodium trichloride, and rhodium ammonium chloride.

An amount of rhodium salts to be added in the emulsions may freely be changed depending on sensitivity or contrast required. It is, however, particularly useful to add then in an amount within the range of $10^{-9}$ to $10^{-4}$ mols per mol of silver.

When adding such rhodium salts, it is also allowed to use other inorganic compounds in combination, such as iridium salts, platinum salts, thalium salts, cobalt salts, and gold salts. Iridium salts may often preferably be used in an amount within the range of $10^{-9}$ to $10^{-4}$ mol per mol of silver used for the purpose of improving characteristics to high intensity exposure.

The silver halides applicable to the invention may be sensitized with a variety of chemical sensitizers including, for example, active gelatin; sulfur-sensitizers such as sodium thiosulfate, allyl thiocarbamide, thiourea, and allyl isothiocyanate; selenium-sensitizers such as N,N-dimethylselenourea, and selenourea; reduction-sensitizers such as triethylene tetramine, and stannous chloride; noble metal-sensitizers such as, typically, potassium chloroaurite, potassium aurothiocyanate, potassium chloroaurate, 2-aurosulfobenzothiazolemethylchloride, ammonium chloropalladate, potassium chloroplatinate, and sodium chloropalladite; which may be used independently or in combination. In the case of using a gold sensitizer, it is also allowed to use ammonium thiocyanate to serve as a sensitizing assistant for the gold sensitizer.

The effects of the invention can be more enhanced when adding a desensitizer and/or a UV absorbent into the silver halide photographic light-sensitive materials relating to the invention.

Such desensitizers preferably applicable include, for example, those represented by the following Formulas III-a to III-e.

Such UV absorbents preferably applicable include, for example, those represented by the following Formulas III-f and III-g.

The above-given compounds may be synthesized through the reference to the following patent specifications, namely, U.S. Pat. Nos. 3,567,456, 3,615,639, 3,579,345, 3,615,608, 3,598,596, 3,598,955, 3,592,653, and 3,582,343; Japanese Patent Examined Publication Nos. 40-26751(1965), 40-27332(1965), 43-13167(1968), 45-8833(1970), and 47-8746(1972).

Formula III-a

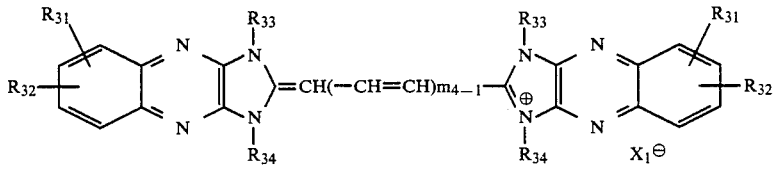

Formula III-b

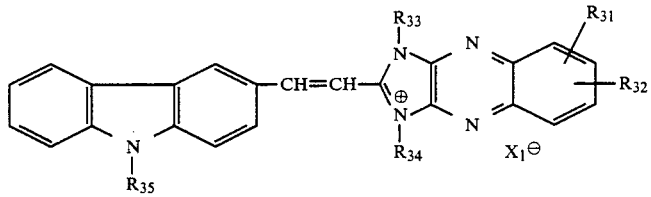

wherein $R_{31}$ and $R_{32}$ are each a hydrogen or halogen atom, or, a cyano or nitro group, provided, $R_{31}$ and $R_{32}$ may complete an aromatic ring; $R_{33}$ and $R_{34}$ are each an alkyl group, a lower alkenyl group, a phenyl group, or a lower hydroxy alkyl group; $m_4$ is a positive integer of 1 to 4; $R_{35}$ is a lower alkyl group or a lower alkyl sulfo group; and $X_1$ is an acid anion.

Formula III-c

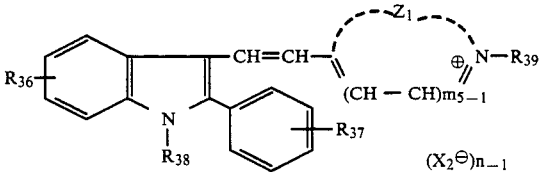

wherein $R_{36}$ and $R_{37}$ are each a hydrogen atom or a nitro group; $R_{38}$ and $R_{39}$ are each a lower alkyl group, an allyl group, or a phenyl group; $Z_1$ is the group of atoms necessary to complete a nucleus of nitrobenzothiazole, nitrobenzooxazole, nitrobenzoselenazole, imidazo[4.5-b]quinooxaline, 3.3-dimethyl-3H-pyrrolo[2.3-b]pyridine, 3.3-dialkyl-3H-nitroindole, thiazolo[4.5-b]quinoline, nitroquinoline, nitrothiazole, nitro naphthothiazole, nitrooxazole, nitronapthoxazole, nitroselenazole, nitronaphthoselenazole, or nitropyridine; $X_2$ is an anion; and $m_5$ and n are each an integer of 1 or 2, provided, when the compound produces an intramolecular salt, n is an integer of 1.

Formula III-d

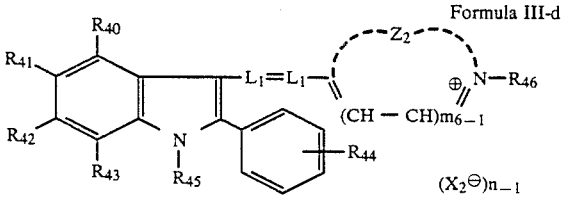

wherein $R_{40}$, $R_{41}$, $R_{42}$, and $R_{43}$ are each a hydrogen or halogen atom, an alkyl group, an alkoxy group, an aryloxy group or a nitro group; $R_{44}$ is a hydrogen atom, an alkyl group, or a nitro group; $Z_2$ is the group of atoms necessary to complete a nucleus of thiazole, benzothiaazole, naphthothiazole, oxazole, benzoxazole, naphthoxazole, selenazole, benzoselenazole, naphthoselenazole, thiazoline, pyridine, quinoline, isoquinoline, 3,3-dialkyl-3H-inzole, imidazole, benzoimidazole, or naphthoimidazole, each of which may be not substituted or substituted with a lower alkyl group, a phenyl group, a thienyl group, a halogen atom, an alkoxy group, a hydroxy group, a cyano group, an alkylsulfonyl group, an alkoxycarbonyl group, a phenylsulfonyl group, or a trifluoromethyl group; $L_1$ and $L_2$ are each a methine chain which is not substituted or substituted with a lower alkyl group or an aryl group; $R_{45}$ and $R_{46}$ a non-substituted or substituted alkyl group, an alkenyl group, an aryl group, a sulfoalkyl group, or an aralkyl group; $X_2$ is an anion; $m_6$ and n represent each an integer of 1 or 2, provided, when the compound produces an intramolecular salt, n is an integer of 1.

Formula III-e

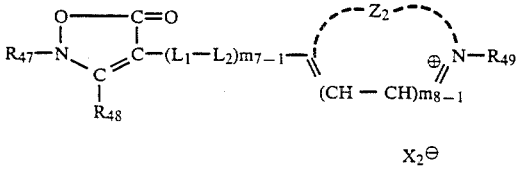

wherein $R_{47}$ and $R_{49}$ are each an alkyl group; $R_{48}$ is an aryl group; $L_1$ and $L_2$ are each a methine chain which is not substituted or substituted with a lower alkyl group or an aryl group; $Z_3$ is the group of atoms necessary to complete a nucleus of thiazole, benzothiaazole, naphthothiazole, oxazole, benzoxazole, naphthoxazole, selenazole, benzoselenazole, naphthoselenazole, thiazoline, pyridine, quinoline, 3.3-dialkylindolenine, imidazole, or imidazo[4/5-b]quinoquixaline; $X_2$ is an anion; $m_7$ is a positive integer of 1 to 3; and $m_8$ is an integer of 1 or 2.

Formula III-f

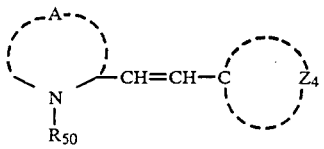

wherein $R_{50}$ is an alkyl group, a hydroxyalkyl group, a cyanoalkyl group, or a sulfoalkyl group; $Z_4$ is the group of atoms necessary to complete a ring of oxazole, thiazole, benzoxazole, benzothiazole, imidazole, and benzoimidazole; and A is the group of atoms necessary to complete a pyrrol ring, or a pyrrolidine ring.

Formula III-g

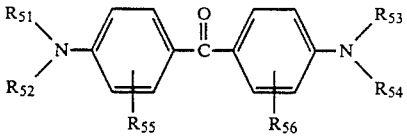

wherein $R_{51}$, $R_{52}$, $R_{53}$, and $R_{54}$ are each an alkyl group, a hydroxyalkyl group, a cyano group, an alkylcyano group, an alkoxy group, or a sulfoalkyl group; and $R_{55}$ and $R_{56}$ are each a sulfo group, or an alkylsulfo group.

Now, the typical exemplified compounds of the desensitizing dyes and the UV absorbents each preferably applicable to the invention will be given below and, it is, however, to be understood that the invention shall not be limited thereto, provided, in the following exemplified compounds III-1 through III-36, there are some compounds not represented by the foregoing formulas and pts stands for a paratoluenesulfonic acid group.

(III-1)

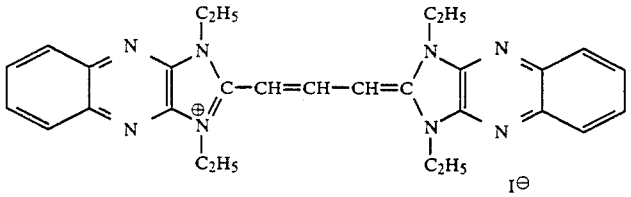

(III-2)

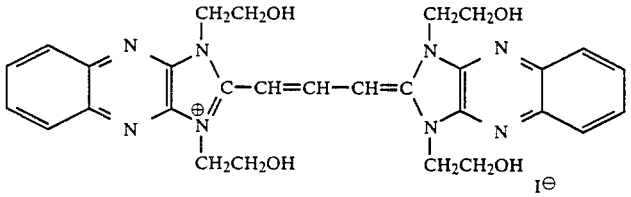

-continued
(III-3)
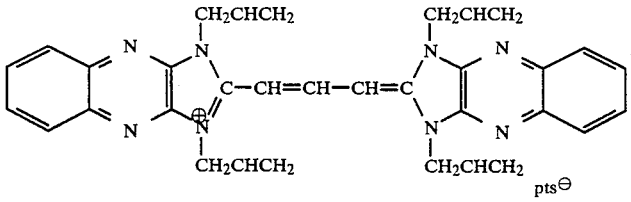
(III-4)
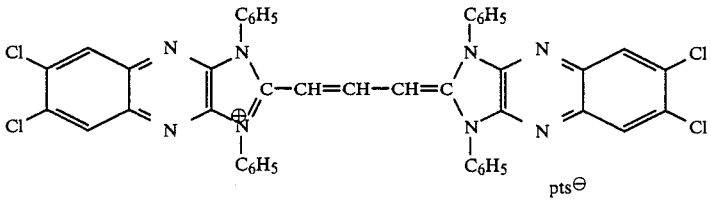
(III-5)
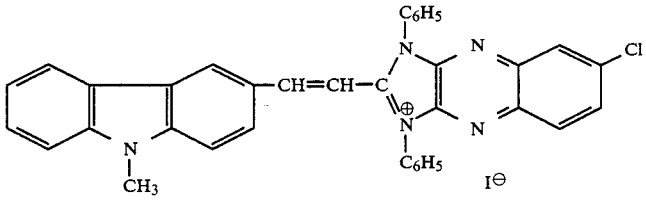
(III-6)
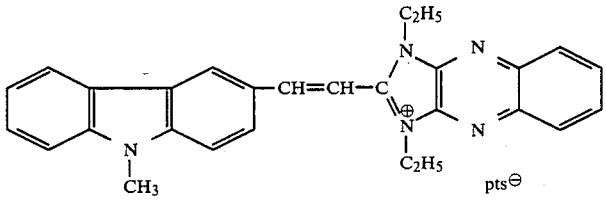
(III-7)
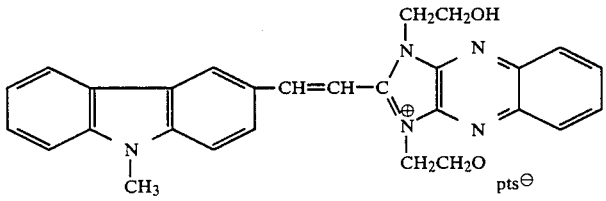
(III-8)
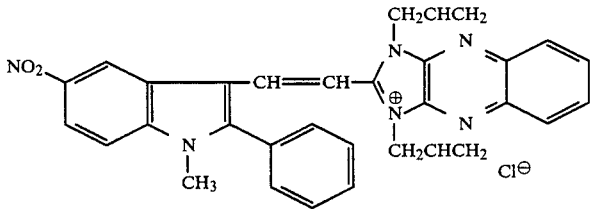
(III-9)
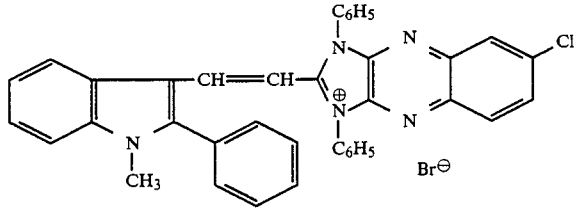

-continued
(III-10)
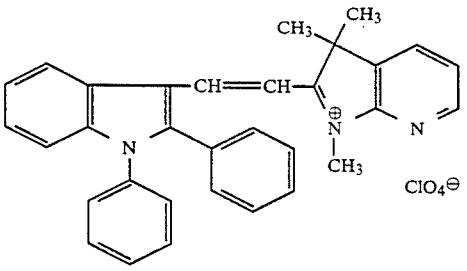
(III-11)
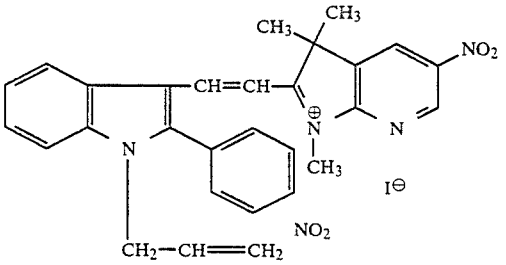
(III-12)
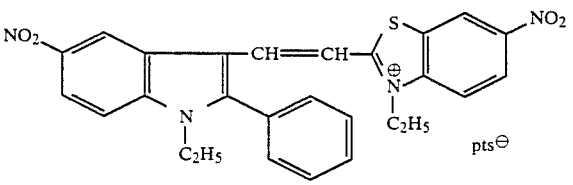
(III-13)
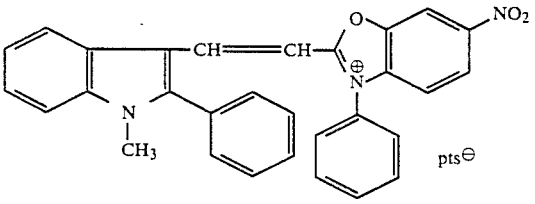
(III-14)
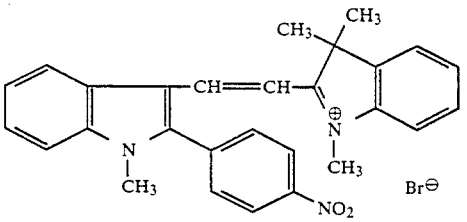
(III-15)
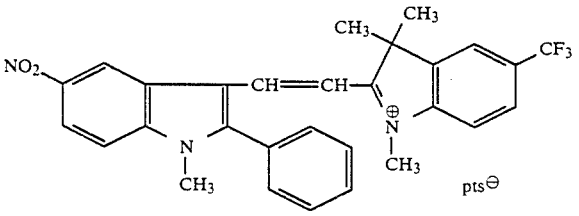
(III-16)
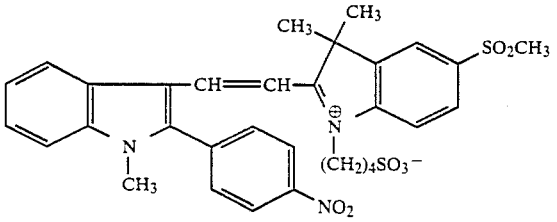

-continued
(III-17)
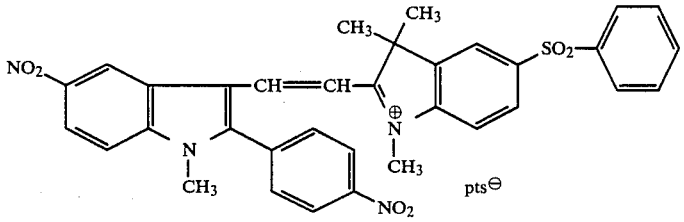
(III-18)
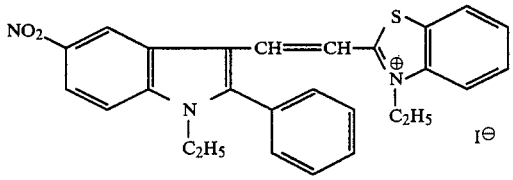
(III-19)
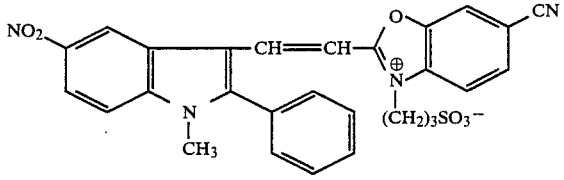
(III-20)
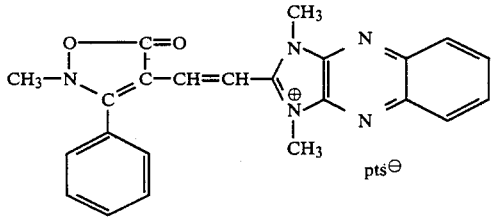
(III-21)
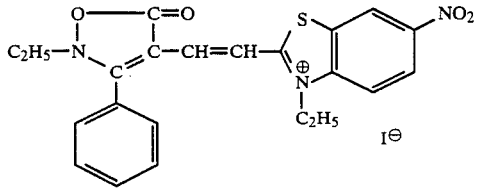
(III-22)
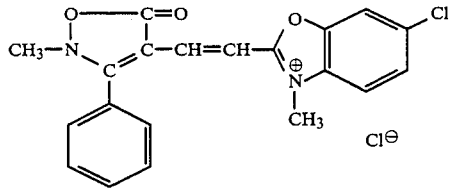
(III-23)
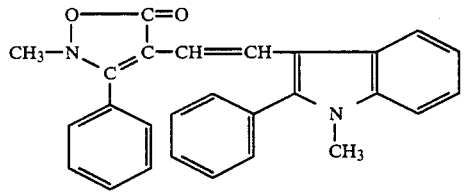

-continued
Phenosafranine (III-24)
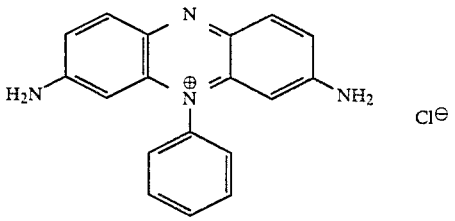
Pinakryptol yellow (III-25)
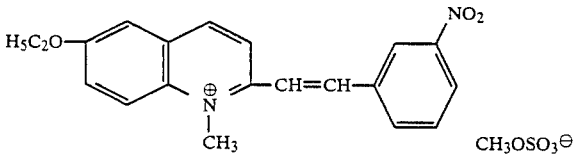
(III-26)
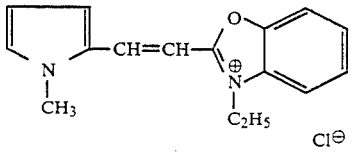
(III-27)
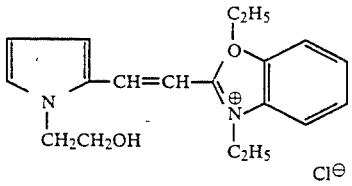
(III-28)
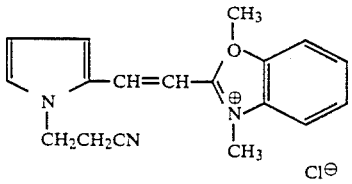
(III-29)
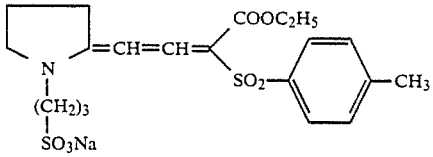
(III-30)
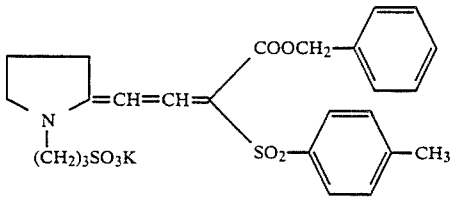
(III-31)
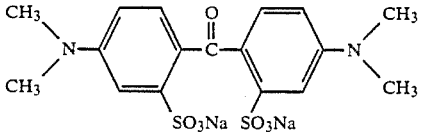

-continued

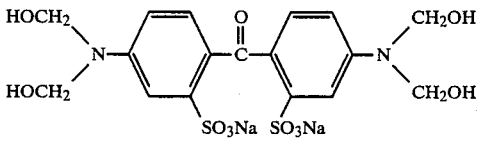
(III-32)

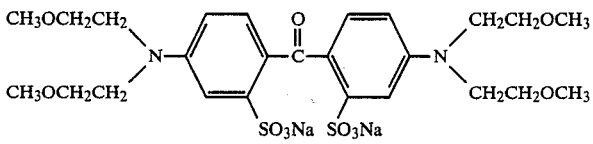
(III-33)

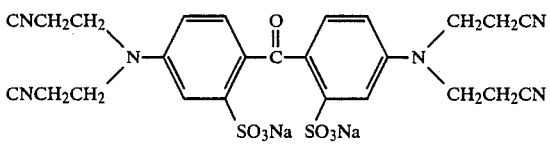
(III-34)

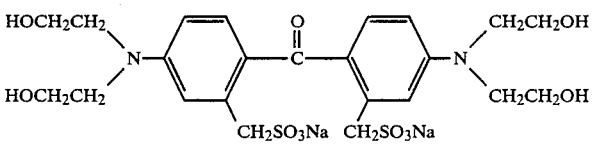
(III-35)

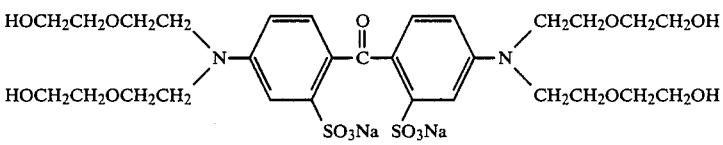
(III-36)

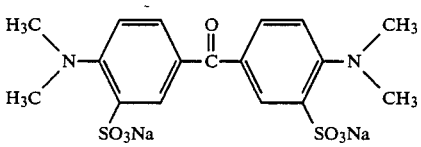
(III-37)

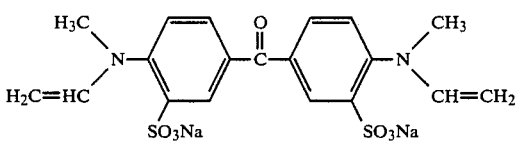
(III-38)

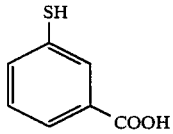
(III-39)

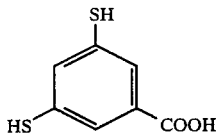
(III-40)

The silver halide emulsions applicable to the invention can be stabilized with the compounds disclosed in, for example, U.S. Pat. Nos. 2,444,607, 2,716,062, 3,512,982, and 3,342,596; West German DAS Patent Nos. 1,189,380, 2,058,626, 2,118,411, and 2,149,789; and Japanese Patent Examined Publication Nos. 43-4133(1968), 47-4417(1972), 39-2825(1964), and 49-13566(1974). Such compounds preferably include, for example, 5,6-trimethylene-7-hydroxy-S-triazolo-(1,5-a)pyrimidine, 5,6-tetramethylene-7-hydroxy-S-triazolo-(1,5-a)pyrimidine, 5-methyl-7-hydroxy-S-triazolo(1,5-a)pyrimidine, 5-methyl-7-hydroxy-S-triazolo(1,5-a)pyrimidine, 7-hydroxy-S-triazolone(1,5-a)pyrimidine, 5-methyl-6-bromo-7-hydroxy-S-triazolo(1,5-a)pyrimidine, gallic acid esters such as isoamyl gallate, dodecyl gallate, propyl gallate, and sodium gallate, mercaptanes such as 1-phenyl-5-mercaptotetrazole, and 2-mercaptobenzthiazole, benzotriazoles such as 5-bromobenztriazole, and 5-methylbenztriazole, and benzimidazoles such as 6-nitrobenzimidazole.

It is preferable to add an amino compound into the silver halide photographic light-sensitive materials relating to the invention and/or a developer.

Such amino compounds preferably applicable to the invention include all the primary amines to the quaternary amines.

The preferable amino compounds include, for example, alkanol amines. The typically preferable examples thereof will be given below. It is, however, to be understood that the invention shall not be limited thereto.

Diethylaminoethanol,
Diethylaminobutanol,
Diethylaminopropane-1,2-diol,
Dimethylaminopropane-1,2-diol,
Diethanolamine,
Diethylamino-1-propanol,
Triethanolamine,
Dipropylaminopropane-1,2-diol,
Dioctylamino-1-ethanol,
Dioctylaminopropane-1,2-diol,
Dodecylaminopropane-1,2-diol,
Dodecylamino-1-propanol,
Dodecylamino-1-ethanol,
Aminopropane-1,2-diol,
Diethylamino-2-propanol,
Dipropanolamine,
Glycine,
Triethylamine,
Triethylenediamine Such amino compounds may be added into at least one layer of the coated layers such as silver halide emulsion layers, protective layer, and hydrophilic colloidal sublayers each provided on the light-sensitive layer of a silver halide photographic light-sensitive material, and/or a developer. One of the preferable embodiments thereof is an embodiment in which such amino compound is added into a developer. An amount of such amino compound to be added depends on the subject to be added, the kinds of such amino compounds, and so forth though, the compound is required to add in an amount so as to enhance a contrast of image.

In order to enhance developability, it is allowed to add a developing agent such as phenidone and hydroquinone, and an inhibitor such as benzotriazole, into the emulsion side; or, in order to enhance the processability of a processing solution, it is also allowed to add a developing agent or an inhibitor into a backing layer.

While one of the hydrophilic colloids particularly advantageous to the invention is gelatin, the other hydrophilic colloids than gelatin include, for example, the following colloids. Namely, colloidal albumin, agar, gum arabic, alginic acid, hydrolyzed cellulose acetate, acrylamide, imidized-polyamide, polyvinyl alcohol, hydrolyzed polyvinyl acetate, gelatin derivatives including phenylcarbamyl gelatin, acylated gelatin, and phthalated gelatin, such as those described in U.S. Pat. Nos. 2,614,928 and 2,525,753, or the compounds obtained by graft-polymerizing polymerizable monomers such as styrene acrylate, acrylate, methacrylic acid, and methacrylate, each having an ethylene group, with gelatin such as described in U.S. Pat. Nos. 2,548,520 and 2,831,767. Such hydrophilic colloids may also be applied to a layer not containing any silver halide, such as an antihalation layer, a protective layer, and an interlayer.

The supports applicable to the invention typically include, for example, baryta paper, polyethylene-laminated paper, polypropylene synthetic paper, glass plate, cellulose acetate film, cellulose nitrate film, polyester film such as polyethyleneterephthalate film. polyamide film, polypropylene film. polycarbonate film. and polystyrene film. The supports may suitably be selected so as to satisfy the purposes of using silver halide photographic light-sensitive materials.

The developing agents applicable to the developments of the silver halide photographic light-sensitive materials of the invention include the following. The typical examples of the HO—(CH=CH)n—OH type developing agents include hydroquinone and. besides, catechol, pyrogallol and the derivatives thereof, ascorbic acid, chlorohydroquinone, bromohydroquinone, methylhydroquinone, 2,3-dibromohydroquinone, 2,5-diethylhydroquinone, catechol 4-chlorocatechol, 4-phenyl-catechol, 3-methoxy-catechol, 4-acetyl-pyrogallol, and sodium ascorbate.

The HO—(CH=CH)n—$NH_2$ type developing agents typically include ortho- or para-aminophenol and, besides, 4-aminophenol, 2-amino-6-phenylphenol, 2-amino-4-chloro-6-phenylphenol, and N-methyl-p-aminophenyl.

Further, the $H_2N$—(CH=CH)n—$NH_2$ type developing agents include, for example, 4-amino-2-methyl-N,N-diethylaniline, 2,4-diamino-N,N-diethylaniline, N-(4-amino-3-methylphenyl)morpholine, and p-phenylenediamine.

The heterocyclic type developing agents include, for example, 3-pyrazolidones such as 1-phenyl-3-pyrazolidone, 1-phenyl-4,4-dimethyl-3-pyrazolidone, and 1-phenyl-4-methyl-4-hydroxymethyl-3-pyrazolidone, 1-phenyl-4-amino-5-pyrazolone, and 5-aminolaucyl.

Besides the above, those described in, for example, T. H. James, The Theory of Photographic Process, 4th Ed., pp. 291–334, and Journal of the American Chemical Society, Vol. 73, p. 3,100, 1951, are also effectively applicable. The above-given developing agents may be used independently or in combination and the combination use is more preferable. Even if a sulfite such as sodium sulfite or potassium sulfite should be added as a preservative into a developer to be used for developing a light-sensitive material of the invention, the addition thereof will detract little from the effects of the invention. A hydroxylamine or hydrozide compound may be used as such a preservative as mentioned above. In this case, it is to be used in an amount within the range of, preferably, 5 to 500 g per liter of a developer used and, more preferably, 20 to 200 g.

Such a developer may contain a glycol to serve as an organic solvent. Such glycols include, for example, ethylene glycol, diethylene glycol, propylene glycol, triethylene glycol. 1,4-butanediol, and 1,5-pentanediol. Among them, diethylene glycol is preferably used. Such glycol may be preferably used in an amount within the range of, preferably, 5 to 500 g per liter of a developer used and, more preferably. 20 to 200 g. These organic solvents may be used independently or in combination.

The developers having the above-mentioned composition should have a pH within the range of, preferably, 9 to 13 and, more preferably, 10 to 12 from the viewpoints of preservability and photographic characteristics. About the cations contained in a developer. potassium ions are more preferable than sodium ions, because the more a potassium ion content is higher than a sodium ion content, the more a developer activity can be made higher.

The silver halide photographic light-sensitive materials of the invention may be processed in various conditions. For example, a developing temperature should preferably be at a temperature of not higher than 50° C. and, more preferably. be at a temperature approximately within the range of 25° to 40° C. It is general to complete a development within 2 minutes and, in particular, it may often produce good results when a development is completed within the range of 10 to 50 seconds. It is also arbitrary to take other processing steps than the developing step. such as the steps of washing, stopping, stabilizing, fixing, and, if required, prehardening and neutralizing. or to appropriately omit such processing steps. Further, such processing steps may be carried out in any processing manners including. for example, the so-called hand processing such as a tray processing and a frame processing. and the mechanical processing such as a roller processing and a hanger processing.

EXAMPLES

Now, the invention will be detailed with reference to the following examples. It is the matter of course that the invention shall not be limited to the following examples.

EXAMPLE-1

<Preparation of Silver halide Emulsion>

The silver halide emulsions were prepared under the acidic atmospheric conditions at a pH of 3.0 in a controlled double-jet process so as to contain rhodium in an amount of $10^{-5}$ mol per mol of silver and to have the average grain-sizes and the silver halide monodispersion degrees shown in Table-1. The grains of each emulsion were grown in the system containing benzyl adenine in an amount of 30 mg per liter of an aqueous 1% gelatin solution. After mixing silver and halide together, 6-methyl-4-hydroxy-1,3,3a,7-tetraazaindene was added in an amount of 600 mg per mol of silver halide and the washing treatments were carried out for desalting.

Further, each of the emulsions was added with 6-methyl-4-hydroxy-1,3,3a,7-tetraazaindene was added in an amount of 60 mg per mol of silver halide and was then sulfur-sensitized. After the sulfur-sensitization was completed, each of the emulsions was added with 6-methyl-4-hydroxy-1,3,3a,7-tetraazaindene so as to serve as a stabilizer.

<Support>

The latex-subbed polyethyleneterephthalate supports each having a thickness of 100 μm were used.

<Layer of the macromolecular compound of the invention>

Emulsions of macromolecular compound of the invention, hereinafter referred as simply polymer of the invention, were prepared each using various kinds of monomers. Preparation method of them were as follows:

| | |
|---|---|
| Monomer having a heterocyclic group substituted with a sulfo group or a alkylsulfo group (see Table 1 and 2) | 100 parts by wt. |
| Ammonium persulfate | 1 part by wt. |
| Water | 400 parts by wt. |

The above mixture was emulsified polymerized in a vessel with reflex condenser for 5 hours at 80° C., and concentrated to produce an emulsion of the polymer of the invention including 30 wt % of solid component.

Thus obtained emulsions were each coated on the subbed surface of the support. The kinds and coating amounts of the emulsions of the macromolecular compound are given in Tables 1 and 2.

<Silver halide emulsion layer>

To the silver emulsion prepared as above, the following additives for masking a coating solution of the emulsion. The solution was coated on the layer of the polymer of the invention provided on the support so as the layer having the following composition to be formed.

| | |
|---|---|
| Latex polymer: Styrene-butyl acrylate-acrylic acid ternary copolymer | 1.0 g/m$^2$ |
| Tetraphenyl phosphonium chloride | 30 mg/m$^2$ |
| Saponin | 200 mg/m$^2$ |
| Polyethylene glycol | 100 mg/m$^2$ |
| Sodium dodecylbenzenesulfonate | 100 mg/m$^2$ |
| Hydroquinone | 200 mg/m$^2$ |
| Phenidone | 100 mg/m$^2$ |
| Styrene-maleic acid polymer | 200 mg/m$^2$ |
| Butyl gallate | 500 mg/m$^2$ |
| Hydrazine compound having Formula I | See Table-1 |
| 5-methylbenzotriazole | 30 mg/m$^2$ |
| Desensitizer having Formula III | See Table-1 |
| 2-mercaptobenzimidazole-5-sulfonic acid | 30 mg/m$^2$ |
| Inert ossein gelatin having an isoelectric point of 4.9 | 1.5 g/m$^2$ |
| 1-(p-acetylamidophenyl)-5-mercaptotetrazole | 30 mg/m$^2$ |
| Silver content | 2.8 g/m$^2$ |

<Protective layer for Emulsion layers>

A protective layer having the following composition was coated on the above-formed silver halide emulsion layer.

| | |
|---|---|
| Fluorinated dioctylsulfosuccinate | 300 mg/m$^2$ |
| Matting agent: Methyl polymethacrylate, having an average particle-size of 3.5 μm | 100 mg/m$^2$ |
| Lithium nitrate | 30 mg/m$^2$ |
| Acid-treated gelatin, having an isoelectric point of 7.0 | 1.2 g/m$^2$ |
| Colloidal silica | 50 mg/m$^2$ |
| Compound represented by Formula II, having a maximum absorption of 50 nm | See Table-1 |
| Styrene-maleic acid copolymer | 100 mg/m$^2$ |
| Mordant having the following structure | 0.5 g/m$^2$ |

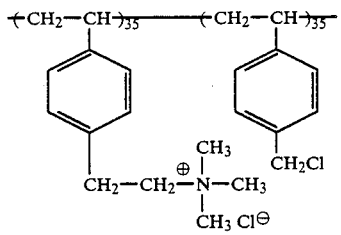

And Sample 8 was added thereto with the following Comparative Dye CD in place of Compound II.

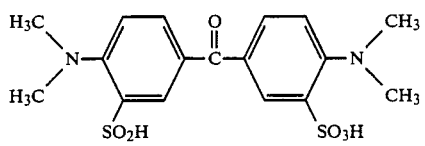

CD

CD was a dye having an absorption maximum in a wavelength region having a difference of not more than 50 mm between a maximum photosensitive wavelength of an emulsion and the absorption maximum of the dye.

<Backing layer>

A backing layer having the following composition was coated over the support on the side opposite to the emulsion layer.

| | |
|---|---|
| Hydroquinone | 100 mg/m$^2$ |
| Phenidone | 30 mg/m$^2$ |
| Latex polymer: | 0.5 mg/m$^2$ |
| Butyl acrylate-styrene copolymer | |
| Styrene-maleic acid copolymer | 100 mg/m$^2$ |
| Citric acid | 40 mg/m$^2$ |
| Saponin | 200 mg/m$^2$ |
| Benzotriazole | 100 mg/m$^2$ |
| Lithium nitrate | 30 mg/m$^2$ |
| Backing dyes | |
| (a) 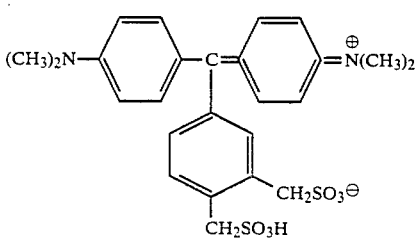 | 40 mg/m$^2$ |
| (b) 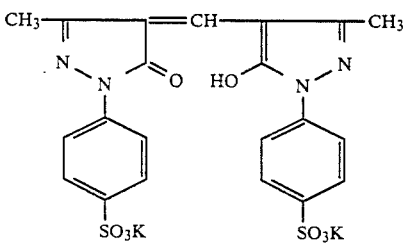 | 30 mg/m$^2$ |
| (c) 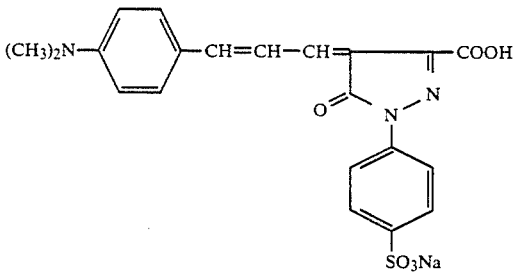 | 30 mg/m$^2$ |
| Ossein gelatin | 2.0 g/m$^2$ |

<Protective layer for backing layer>

On a protective layer having the following composition was coated on the backing layer so as to be in the following amounts.

| | |
|---|---|
| Dioctyl sulfosuccinate | 300 mg/m$^2$ |
| Matting agent: Methyl polymethacrylate, having an average particle-size of 4.0 μm | 100 mg/m$^2$ |
| Colloidal silica | 30 mg/m$^2$ |
| Ossein gelatin having an isoelectric point of 4.9 | 1.1 g/m$^2$ |
| Fluorinated Sodium fluorododecylbenzene-sulfonate | 50 mg/m$^2$ |

The samples thus prepared were exposed to light emitted from the light-sources shown in Table-1, and were then treated with the following developer and fixer, respectively.

<Method of exposure>

Beneath a glass plate, a non-electrode discharging light-source called V-bulb having a maximum specific-energy within the range of 400 to 420 nm, manufactured by Fusion Co., U.S.A., or a conventional type light-source called D-bulb having a maximum specific-energy within the range of 350 to 380 nm was attached. An original document and a light-sensitive material were placed on the glass plate and were then exposed to light so that the quality of a reverse-text could be evaluated.

<Composition of developer>

-continued

| | |
|---|---|
| Hydroquinone | 25 g |
| 1-phenyl-4,4-dimethyl-3-pyrazolidone | 0.4 g |
| Sodium bromide | 3 g |
| 5-methylbenzotriazole | 0.3 g |
| 5-nitroindazole | 0.05 g |
| Diethylaminopropane-1,2-diol | 10 g |
| Potassium sulfite | 90 g |
| Sodium 5-sulfosalicylate | 75 g |
| Sodium ethylenediaminetetraacetate | 2 g |
| Add water to make | 1 liter |
| Adjust pH with sodium hydroxide to | pH = 11.5 |
| <Composition of fixer> | |
| Composition A | |
| Ammonium thiosulfate in an aqueous 72.5 w % solution | 240 ml |
| Sodium sulfite | 17 g |
| Sodium acetate, trihydrate | 6.5 g |
| Boric acid | 6 g |
| Sodium citrate, dihydrate | 2 g |
| Acetic acid in an aqueous 90 w % solution | 13.6 ml |
| Composition B | |
| Pure water ion-exchanged water | 17 ml |
| Sulfuric acid, in an aqueous 50 w % solution | 4.7 g |
| Aluminium sulfate in an aqueous 8.1 w % solution in terms of an $Al_2O_3$ content | 26.5 g |

The above-given compositions A and B were dissolved in order in 500 ml of water to make 1 liter and the resulting solution was used as the fixer. the pH value of the fixer was about pH=4.3.

<Processing conditions>

| Processing step | Temperature | Time |
|---|---|---|
| Developing | 40° C. | 15 sec. |

-continued

| Processing step | Temperature | Time |
|---|---|---|
| Fixing | 35° C. | 10 sec. |
| Washing | At ordinary temperature | 10 sec. |

The evaluations were made as described below and the results thereof are shown in Table-1.

<Method of evaluating photographic characteristics>

<1> Characteristics improved on pin-holes

The sample of the light-sensitive material is be tested was contacted to a film having 50% halftone dot image and exposed to light and processed. The pin-holes produced on the halftone image formed on the samples were evaluated by five grades. In the 5-grade evaluation, it was evaluated as Grade 5 when no pin-hole was found; Grade 3 when pin-holes could be remedied; Grade 1 when the most numerous pin-holes were found; and so forth, respectively.

<2> Reverse-text quality

A reverse-text quality means a quality of reversed image of 50 μm-width line contact printed on a sample to be tested from a line image chart superposed on a halftone image when the exposure is given so as a 50% halftone dot area of an original image to be represented as a 50% halftone dot area on the print. Each of the reverse-text quality was evaluated by 5 grades. It was evaluated as Grade 5 when the lines of a reverse-text could sharply be reproduced; Grade 1 when the lines could scarcely be identified; and so forth, respectively.

The results of the evaluations are shown in Table-1.

TABLE 1

| | | Silver halide grain | | | | | | Compound having Formula Ia | | Compound having Formula II | | | Polymer of invention | |
|---|---|---|---|---|---|---|---|---|---|---|---|---|---|---|
| Sample | Sample No. | Average grain size (μm) | Monodispersion degree | AgX composition (mol %) Cl | Br | I | Max. spectral wavelength | No. | Amount added (g/m²) | No. | Amount added (g/m²) | Absorption max. wavelength | Kind | Amount added (g/m²) |
| Comp. | 1 | 0.10 | 15 | 90 | 10 | 0 | 370 | — | — | — | — | — | — | — |
| " | 2 | 0.10 | 15 | 90 | 10 | 0 | 370 | — | — | — | — | — | (8) | 1.0 |
| " | 3 | 0.10 | 15 | 90 | 10 | 0 | 370 | — | — | II-14 | 0.5 | 480 | — | — |
| " | 4 | 0.10 | 15 | 90 | 10 | 0 | 370 | 1-1 | 31 | — | — | — | — | — |
| " | 5 | 0.10 | 15 | 90 | 10 | 0 | 370 | — | — | II-14 | 0.5 | 480 | (8) | 1.0 |
| " | 6 | 0.10 | 15 | 90 | 10 | 0 | 370 | 1-1 | 31 | — | — | — | (8) | 1.0 |
| " | 7 | 0.10 | 15 | 90 | 10 | 0 | 370 | 1-1 | 31 | II-14 | 0.5 | 480 | — | — |
| " | 8 | 0.10 | 15 | 90 | 10 | 0 | 370 | 1-1 | 31 | CD | 0.5 | 370 | (8) | 1.0 |
| Inv. | 9 | 0.10 | 15 | 90 | 10 | 0 | 370 | 1-1 | 31 | II-14 | 0.5 | 480 | (8) | 1.0 |
| " | 10 | 0.10 | 15 | 90 | 10 | 0 | 370 | 1-1 | 31 | II-14 | 0.5 | 480 | (1) | 1.0 |
| " | 11 | 0.10 | 15 | 90 | 10 | 0 | 370 | 1-1 | 31 | II-14 | 0.5 | 480 | (2) | 1.0 |
| " | 12 | 0.10 | 15 | 90 | 10 | 0 | 370 | 1-3 | 31 | II-28 | 0.5 | 430 | (4) | 1.0 |
| " | 13 | 0.10 | 15 | 90 | 10 | 0 | 370 | 1-3 | 31 | II-28 | 0.5 | 430 | (5) | 1.0 |
| " | 14 | 0.12 | 18 | 100 | 0 | 0 | 360 | 1-3 | 31 | II-28 | 0.5 | 430 | (8) | 1.0 |
| " | 15 | 0.12 | 18 | 100 | 0 | 0 | 360 | 1-3 | 31 | II-28 | 0.5 | 430 | (11) | 1.0 |
| " | 16 | 0.11 | 16 | 95 | 5 | 0 | 365 | 1-47 | 40 | II-13 | 0.5 | 500 | (16) | 1.0 |
| " | 17 | 0.11 | 16 | 95 | 5 | 0 | 365 | 1-47 | 40 | II-13 | 0.5 | 500 | (17) | 1.0 |
| " | 18 | 0.15 | 15 | 90 | 9 | 1 | 367 | 1-47 | 40 | II-13 | 0.5 | 500 | (19) | 1.0 |
| " | 19 | 0.15 | 15 | 90 | 9 | 1 | 367 | 1-47 | 40 | II-13 | 0.5 | 500 | (20) | 1.0 |
| " | 20 | 0.15 | 15 | 90 | 9 | 1 | 367 | 1-48 | 40 | II-14 | 0.5 | 480 | (21) | 1.0 |
| " | 21 | 0.20 | 15 | 100 | 0 | 0 | 360 | 1-49 | 40 | II-14 | 0.5 | 480 | (21) | 1.0 |
| " | 22 | 0.20 | 15 | 100 | 0 | 0 | 360 | 1-50 | 40 | II-14 | 0.5 | 480 | (21) | 2.0 |
| " | 23 | 0.20 | 15 | 100 | 0 | 0 | 360 | 1-51 | 40 | II-14 | 0.5 | 480 | (21) | 2.0 |
| " | 24 | 0.20 | 15 | 100 | 0 | 0 | 360 | 1-53 | 40 | II-14 | 0.5 | 480 | (21) | 2.0 |
| " | 25 | 0.20 | 15 | 100 | 0 | 0 | 360 | 1-53 | 40 | II-14 | 0.5 | 480 | (23) | 2.0 |
| " | 26 | 0.20 | 15 | 100 | 0 | 0 | 360 | 1-53 | 40 | II-14 | 0.5 | 480 | (23) | 2.0 |

| Sample | Sample No. | Compound having Formula III No. | Amount added (mg/m²) | Exposure light-source * | Photographic characteristics Pin-hole improvement | Reverse-text quality |
|---|---|---|---|---|---|---|

TABLE 1-continued

| | | | | | | |
|---|---|---|---|---|---|---|
| Comp. | 1 | — | — | D bulb | 1 | 1 |
| " | 2 | — | — | " | 2 | 1 |
| " | 3 | — | — | " | 1 | 1 |
| " | 4 | — | — | " | 2 | 2 |
| " | 5 | — | — | " | 2.5 | 1 |
| " | 6 | — | — | " | 2 | 2 |
| " | 7 | — | — | " | 1 | 2 |
| " | 8 | — | — | " | 2.5 | 3 |
| Inv. | 9 | — | — | D bulb | 4 | 3 |
| " | 10 | — | — | " | 4 | 3 |
| " | 11 | — | — | " | 4 | 3 |
| " | 12 | — | — | " | 4 | 3 |
| " | 13 | — | — | " | 4 | 3 |
| " | 14 | III-31 | 33 | " | 4 | 4 |
| " | 15 | III-31 | 33 | " | 4 | 4 |
| " | 16 | III-4 | 20 | " | 4 | 5 |
| " | 17 | III-4 | 20 | " | 4 | 4 |
| " | 18 | III-4 | 20 | " | 4 | 5 |
| " | 19 | III-4 | 20 | " | 4 | 5 |
| " | 20 | III-18 | 26 | " | 4 | 5 |
| " | 21 | III-18 | 26 | " | 4 | 5 |
| " | 22 | III-18 | 26 | " | 4 | 5 |
| " | 23 | III-18 | 26 | " | 4 | 5 |
| " | 24 | III-18 | 26 | " | 4 | 5 |
| " | 25 | III-18 | 26 | V bulb | 5 | 5 |
| " | 26 | III-18 | 26 | " | 5 | 5 |

From Table-1, it is understood that pin-hole productions can be prevented and, at the same time, the characteristics of reverse-texts can also be improved, when arranging a layer containing the dye represented by Formula II of as a protective layer onto a silver halide emulsion layer containing the hydrozine compound represented by Formula I and a layer containing a polymer of the invention between the support and the silver halide emulsion layer.

It is further proved that a light-sensitive material having remarkably improved reverse-text characteristics and a few pin-hole productions can be obtained when exposing the light-sensitive material to light emitted from a light-source having a maximum energy within the range of 400 to 420 nm, as the light-source for it.

EXAMPLE-2

In this example. the samples were prepared in the same manner as in Example-1, except that the mixture of main silver halide grains and secondary ones was used. The main silver halide grains were 2 mol % iodide-containing cubic silver iodobromide grains having an average grain-size of 0.12 μm and a monodispersion degree of 15 and further containing rhodium in an amount of $10^{-5}$ mols thereinside. The secondary silver halide grains were 2 mol % silver bromide-containing cubic silver chlorobromide grains having an average grain-size of 0.08 μm and a monodispersion degree of 15 and further containing $2\times10^{-5}$ mol of rhodium thereinside and, those were lower than the main grains in sensitivity. The above-mentioned two kinds of grains were mixed up in a proportion of 1 part of the main grains to 10 parts of the secondary grains and the same additives as in Example-1 were added, so that the samples of this example were prepared. The wavelength of sensitivity maximum of the emulsion was 405 nm. The resulting samples were exposed to light and processed.

The results thereof are shown in Table-2.

TABLE 2

| | | Compound having Formula I {Ib-Id} | | Compound having Formula II | | | Polymer of invention | | Compound having Formula III | | Exposure light-source | Photographic characteristics | |
|---|---|---|---|---|---|---|---|---|---|---|---|---|---|
| Sample | Sample No. | No. | (mg/m²) | No. | Amount added (g/m²) | Absorption max. wave-length | Kind | Amount added (g/m²) | No. | Amount added (g/m²) | * | Pin-hole improvement | Reverse-text quality |
| Comp. | 27 | (2) | 20 | — | — | — | — | — | — | — | V | 2 | 4 |
| " | 28 | (3) | 30 | (II-4) | 0.5 | 486 | — | — | — | — | " | 2 | 4 |
| " | 29 | (2) | 20 | — | — | — | (19) | 1.0 | — | — | " | 2.5 | 4 |
| " | 30 | (2) | 20 | CD | 0.5 | 370 | (19) | 1.0 | — | — | " | 2.5 | 4 |
| Inv. | 31 | (2) | 20 | (II-4) | 0.5 | 486 | (19) | 1.0 | — | — | " | 4 | 4 |
| " | 32 | (6) | 30 | (II-5) | 0.5 | 490 | (19) | 1.0 | — | — | " | 4 | 4 |
| " | 33 | (8) | 30 | (II-6) | 0.5 | 470 | (19) | 1.0 | — | — | " | 4 | 4 |
| " | 34 | (10) | 30 | (II-6) | 0.5 | 470 | (19) | 1.0 | — | — | " | 4 | 4 |
| " | 35 | (11) | 30 | (II-6) | 0.5 | 470 | (19) | 1.0 | — | — | " | 4 | 4 |
| " | 36 | (12) | 30 | (II-13) | 0.5 | 500 | (9) | 1.0 | — | — | " | 4 | 4 |
| " | 37 | (13) | 30 | (II-13) | 0.5 | 500 | (10) | 1.0 | III-18 | 45 | " | 5 | 5 |
| " | 38 | (3) | 20 | (II-13) | 0.5 | 500 | (11) | 1.0 | III-20 | 60 | " | 5 | 5 |
| " | 39 | (3) | 20 | (II-15) | 0.5 | 480 | (12) | 1.0 | III-20 | 30 | " | 5 | 5 |
| " | 40 | (3) | 20 | (II-16) | 0.5 | 486 | (13) | 1.0 | III-24 | 20 | " | 5 | 5 |
| " | 41 | (15) | 30 | (II-16) | 0.5 | 486 | (14) | 1.0 | III-26 | 20 | " | 5 | 5 |
| " | 42 | (16) | 30 | (II-18) | 0.5 | 472 | (16) | 2.0 | III-28 | 50 | " | 5 | 5 |
| " | 43 | (18) | 30 | (II-19) | 0.5 | 590 | (17) | 2.0 | III-29 | 50 | " | 5 | 5 |

As is obvious from the results shown in Table-2, it can be understood that, in the combination relating to the invention, pin-hole production can be prevented and reverse-text characteristics can also be improved by providing a layer containing a polymer of the invention, even when applying a tetrazolium compound into a silver halide emulsion.

What is claimed is:

1. A silver halide photographic light-sensitive material comprising a support having thereon a silver halide emulsion layer containing a silver halide emulsion and a hydrazine compound or a tetrazolium compound, a layer being provided on the surface of said emulsion layer farther from said support and containing a compound having a maximum spectral absorption at a wavelength of at least 50 nm longer than that of the maximum spectral sensitivity of said silver halide emulsion, and a layer being interposed between said support and said emulsion layer containing a macromolecular compound synthesized from ethylenically unsaturated monomers having a heterocyclic group with a sulfo group or an alkylsulfo group as a substituent; said heterocyclic group being a pyridyl group, a pyrrodyl group, a carbazolyl group, a pyrrolyl group, a thienyl group, a furyl group or an indolyl group.

2. The material of claim 1, wherein said hydrazine compound is a compound represented by the following Formula Ia:

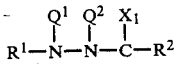

(Ia)

wherein $R^1$ is a monovalent organic group; $R^2$ is a hydrogen atom or a monovalent organic group; $Q_1$ and $Q_2$ are each a hydrogen atom, a substituted or unsubstituted alkylsulfonyl group or a substituted or unsubstituted arylsulfonyl group; and $X_1$ is an oxygen atom or a sulfur atom.

3. The material of claim 1, wherein said hydrazine compound is contained said silver halide emulsion layer in an amount of $10^{-5}$ mol to $10^{-1}$ mol per mol of silver halide contained in said emulsion layer.

4. The material of claim 3, wherein said hydrazine compound is contained said silver halide emulsion layer in an amount of $10^{-4}$ mol to $10^{-2}$ mol per mol of silver halide contained in said emulsion layer.

5. The material of claim 1, wherein said terazolium compound is a compound represented by the following Formula Ib, Ic or Id:

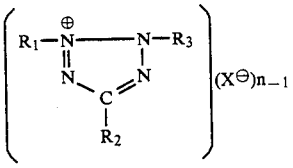

(Ib)

-continued

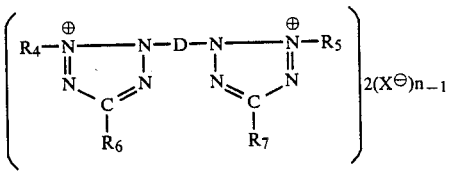

(Ic)

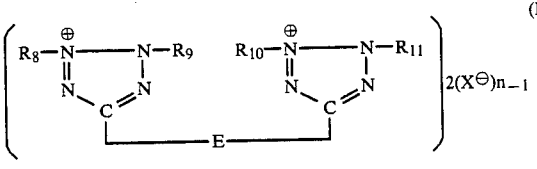

(Id)

wherein $R_1$, $R_3$, $R_4$, $R_5$, $R_8$, $R_9$, $R_{10}$ and $R_{11}$ are each an alkyl group, an alkenyl group, an aryl group or a heterocyclic group, provided that these groups are allowed to have a substituent; $R_2$, $R_6$ and $R_7$ are each an allyl group, a phenyl group, a naphthyl group, a heterocyclic group, an alkyl group, a hydroxyl group, a carboxyl group, an alkoxycarbonyl hydrogen atom, provided that these groups are allowed to have a substituent; D is an aromatic group; E is an alkylene group, an arylene group or a aralkylene group; $X^{\ominus}$ is an anion and n is an integer of 1 or 2, provided that n is 1 when an intramolecular salt is formed.

6. The material of claim 1, wherein said tetrazolium compound is contained in said silver halide emulsion layer in an amount of from $10^{-6}$ mol to 10 mol per mol of silver halide contained said emulsion layer.

7. The material of claim 6, wherein said tetrazolium compound is contained in said silver halide emulsion layer in an amount of from $2\times10^{-4}$ mol to $2\times10^{-1}$ mol per mol of silver halide contained said emulsion layer.

8. The material of claim 1, wherein said layer interposed between said support and said emulsion layer contains said macromolecular compound in an amount of from $10^{-3}$ mg/m$^2$ to $10^3$ mg/m$^2$.

9. The material of claim 8, wherein said layer contains said macromolecular compound in an amount of from $10^{-1}$ mg/m$^2$ to $10^2$ mg/m$^2$.

10. The material of claim 1, wherein the substituent on the heterocyclic group is an alkylsulfo group with 1 to 16 carbon atoms.

11. The material of claim 1, wherein the substituent on the heterocyclic group is the sulfo group.

12. The material of claim 1, wherein the heterocyclic group is the pyridyl group.

13. The material of claim 1, wherein the heterocyclic group is the pyrrodyl.

14. The material of claim 1, wherein the heterocyclic group is the carbazolyl group.

15. The material of claim 1, wherein the heterocyclic group is the pyrrolyl group.

16. The material of claim 1, wherein the heterocyclic group is the thienyl group.

17. The material of claim 1, wherein the heterocyclic group is the furyl group.

18. The material of claim 1, wherein the heterocyclic group is the indolyl group.

* * * * *